US007995950B2

(12) United States Patent
Nakamori

(10) Patent No.: US 7,995,950 B2
(45) Date of Patent: Aug. 9, 2011

(54) IMAGE FORMING APPARATUS, IMAGE FORMING METHOD AND PROCESS CARTRIDGE INVOLVING THE USE OF A CLEANING BLADE THAT REMOVES TONER REMAINING ON A SURFACE OF AN IMAGE BEARING MEMBER

(75) Inventor: Hideo Nakamori, Numazu (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 12/817,710

(22) Filed: Jun. 17, 2010

(65) Prior Publication Data

US 2010/0254739 A1 Oct. 7, 2010

Related U.S. Application Data

(62) Division of application No. 11/487,573, filed on Jul. 17, 2006.

(30) Foreign Application Priority Data

Jul. 15, 2005 (JP) ..... 2005-207355

(51) Int. Cl.
*G03G 15/00* (2006.01)

(52) U.S. Cl. ..... 399/159

(58) Field of Classification Search ..... 399/159
See application file for complete search history.

(56) References Cited

U.S. PATENT DOCUMENTS 4,772,525 A 9/1988 Badesha et al.
5,066,983 A 11/1991 Tonomoto
6,203,962 B1 3/2001 Itami et al.
6,219,505 B1 4/2001 Sato et al.
6,456,820 B1 9/2002 Sato et al.
6,605,399 B2 8/2003 Chowdry et al.
(Continued)

FOREIGN PATENT DOCUMENTS

JP 54-9632 1/1979
(Continued)

OTHER PUBLICATIONS

Hiroyuki Suematsu, "The Role and the Technology Development of Electrophotographic Toner", Journal of the Imaging Society of Japan, No. 1, vol. 43, pp. 26-32, 2004.

(Continued)

*Primary Examiner* — David M Gray
*Assistant Examiner* — Andrew V Do
(74) *Attorney, Agent, or Firm* — Oblon, Spivak, McClelland, Maier & Neustadt, L.L.P.

(57) ABSTRACT

An image forming apparatus including an image bearing member having a static friction coefficient of from 0.1 to 0.3, a latent electrostatic image forming device, a developing device, and a cleaning device including a cleaning blade to remove remaining toner, in which the contact pressure of the cleaning blade to the image bearing member ranges from 1.5 to 10 g/cm, and the image bearing member and the cleaning blade satisfy the following relationships (1) and (2):

$$0.01\ (\text{kg}) \leqq (T_{off}-T_0)/r \leqq 0.15\ (\text{kg}) \quad \text{Relationship (1)}$$

$$1.2 \leqq (T_{on}-T_0)/(T_{off}-T_0) \leqq 3.8, \quad \text{Relationship (2)}$$

wherein $T_0$ (kgcm) represents the rotation torque of the image bearing member when the cleaning blade is not in contact therewith, $T_{off}$, the rotation torque when the cleaning blade contacts the image bearing member and the toner is not thereon, $T_{on}$, the rotation torque when the cleaning blade contacts the image bearing member and the toner is thereon for development, and r represents the radius of the image bearing member.

15 Claims, 6 Drawing Sheets

U.S. PATENT DOCUMENTS

| | | | | |
|---|---|---|---|---|
| 6,816,691 | B2 | 11/2004 | Kabata et al. | |
| 7,027,759 | B2 | 4/2006 | Kabata et al. | |
| 2002/0028100 | A1 | 3/2002 | Kubo et al. | |
| 2004/0170455 | A1 | 9/2004 | Shintani et al. | |
| 2004/0224247 | A1 | 11/2004 | Sasaki et al. | |
| 2005/0026058 | A1 * | 2/2005 | Kami et al. | 430/66 |
| 2005/0053853 | A1 | 3/2005 | Sugino et al. | |
| 2005/0118518 | A1 | 6/2005 | Ikegami et al. | |
| 2005/0130050 | A1 | 6/2005 | Takada et al. | |

FOREIGN PATENT DOCUMENTS

| | | |
|---|---|---|
| JP | 54-11737 | 1/1979 |
| JP | 57-78402 | 5/1982 |
| JP | 61-20953 | 1/1986 |
| JP | 61-296358 | 12/1986 |
| JP | 63-39899 | 8/1988 |
| JP | 64-88461 | 4/1989 |
| JP | 1-134456 | 5/1989 |
| JP | 1-134457 | 5/1989 |
| JP | 1-179164 | 7/1989 |
| JP | 2-282264 | 11/1990 |
| JP | 2-304456 | 12/1990 |
| JP | 4-264130 | 9/1992 |
| JP | 4-264131 | 9/1992 |
| JP | 4-264132 | 9/1992 |
| JP | 4-264133 | 9/1992 |
| JP | 4-289867 | 10/1992 |
| JP | 4-352186 | 12/1992 |
| JP | 5-40350 | 2/1993 |
| JP | 05-323833 | 7/1993 |
| JP | 6-67500 | 3/1994 |
| JP | 6-234836 | 8/1994 |
| JP | 6-234837 | 8/1994 |
| JP | 6-234840 | 8/1994 |
| JP | 6-234841 | 8/1994 |
| JP | 7-10912 | 2/1995 |
| JP | 8-83028 | 3/1996 |
| JP | 2546739 | 8/1996 |
| JP | 2591793 | 12/1996 |
| JP | 2596588 | 1/1997 |
| JP | 9-127713 | 5/1997 |
| JP | 9-166919 | 6/1997 |
| JP | 9-211877 | 8/1997 |
| JP | 9-304956 | 11/1997 |
| JP | 10-111629 | 4/1998 |
| JP | 2775893 | 5/1998 |
| JP | 2805867 | 7/1998 |
| JP | 2847827 | 11/1998 |
| JP | 2847828 | 11/1998 |
| JP | 2852464 | 11/1998 |
| JP | 2889652 | 2/1999 |
| JP | 2958100 | 7/1999 |
| JP | 2958101 | 7/1999 |
| JP | 11-327191 | 11/1999 |
| JP | 2000-75527 | 3/2000 |
| JP | 3096354 | 8/2000 |
| JP | 3124784 | 10/2000 |
| JP | 2001-83734 | 3/2001 |
| JP | 3164426 | 3/2001 |
| JP | 3183353 | 4/2001 |
| JP | 3189914 | 5/2001 |
| JP | 3224031 | 8/2001 |
| JP | 2001-296781 | 10/2001 |
| JP | 3252241 | 11/2001 |
| JP | 2002-31994 | 1/2002 |
| JP | 2002-82586 | 3/2002 |
| JP | 3406099 | 3/2003 |
| JP | 3514591 | 1/2004 |
| JP | 3527817 | 2/2004 |
| JP | 3549350 | 4/2004 |
| JP | 2005-62820 | 3/2005 |
| JP | 2005-62830 | 3/2005 |
| JP | 2005-172968 | 6/2005 |

OTHER PUBLICATIONS

Takuji Kishimoto, "Encapsulated Polymerization Toner", Journal of the Imaging Society of Japan, No. 1, vol. 43, pp. 33-39, 2004.

Mikio Kouyama, "Konica-Minolta Digital Toner by Emulsion Coagulation Method", Journal of the Imaging Society of Japan, No. 1, vol. 43, pp. 40-47, 2004.

Yutaka Sugizaki, et al., "Technology Development of Spherical Polyester Toner by Suspension of Polymer/Pigment Solution and Solvent Removal Method", Journal of the Imaging Society of Japan, No. 1, vol. 43, pp. 48-53, 2004.

Office Action issued Nov. 2, 2010 in JP Application No. 2005-207355.

* cited by examiner

IMAGE FORMING APPARATUS, IMAGE FORMING METHOD AND PROCESS CARTRIDGE INVOLVING THE USE OF A CLEANING BLADE THAT REMOVES TONER REMAINING ON A SURFACE OF AN IMAGE BEARING MEMBER

CROSS REFERENCE TO RELATED APPLICATION

The present divisional application claims the benefit of priority under 35 U.S.C. §120 to application Ser. No. 11/487,573, filed on Jul. 17, 2006, and claims the benefit of priority under 35 U.S.C. §119 from Japanese Application No. 2005-207355, filed on Jul. 15, 2005, the entire contents of both of which are hereby incorporated herein by reference.

BACKGROUND OF THE INVENTION

1. Field of the Invention

The present invention relates to an image forming apparatus and its corresponding image forming method and process cartridge. More particularly, the present invention relates to an image forming apparatus using a cleaning blade to remove toner remaining on the surface of an image bearing member.

2. Discussion of the Background

There are known methods of electrophotography. For example, Carson Process and its variations are widely applied in photocopiers and printers. Recently, image forming apparatuses adopting electrophotography have been improved in colorization, image quality and processing speed. apparatus is widely diffused. In addition, a polymerized toner having a small particle diameter with a sharp distribution is applied in more and more cases due to its advantage in image quality. However, such a polymerized toner having a small particle diameter with a sharp distribution has a substantially sphere form so that the toner easily sneaks through between a blade and an image bearing member. Therefore, a blade cleaning system is not suitable when such a polymerized toner is used. To improve the cleaning performance for a polymerized toner, increasing the contact pressure of a cleaning blade has been considered.

When the contact pressure of a cleaning blade is increased, the amount of sneaking toner is reduced. However, the toner is excessively pressed against the surface of an image bearing member, which leads to a side-effect, such as the occurrence of filming on the image bearing member. Furthermore, abrasion of the image bearing member and the blade edge is easily accelerated, resulting in shortening of life thereof. Furthermore, this invites the increase in the rotation torque of the image bearing member, which leads to an increase in the power consumption of the image forming apparatus.

In addition, when the contact pressure of a blade is not suitable, filming occurs on the surface of an image bearing member. As the image forming process is repeated, the filming increases and causes abnormal images on the portion corresponding to the filming portion. When the filming portion increases further, a slight gap is formed in the contact portion between the blade and the image bearing member, which may lead to abnormal images such as streaks on an image caused by toner sneaking therebetween.

There are the following countermeasures to the filming which easily occurs in the case of inappropriate blade contact pressure as described above.

Unexamined published Japanese patent applications Nos. (hereinafter referred to as JOP) H05-323833 and 2001-296781 describe an image forming apparatus including an abrading blade to abrade an image bearing member. JOP H10-111629 describes a method of abrading the surface of an image bearing member with a roller having an abrasive agent.

However, in these countermeasures, not only the filming but also the image bearing member itself are abraded so that the abrasion of the image bearing member is accelerated, which leads to a shortening of the life thereof.

JOP H06-67500 describes a technology in which a toner containing an inorganic particulate and an organic particulate abrades the surface of an image bearing member. However, this technology involves the increase of toner consumption for abrasion. JOP 2001-83734 describes a technology in which an abrasive agent particulate contained in a toner abrades the surface of an image bearing member. However, the abrasive agent particulate tends to abrade the image bearing member and the cleaning blade, which may lead to a shortening of the life thereof.

Japanese patents Nos. (hereinafter referred to as JPP) 3406099 and 3514591 describe a technology in which a lubricant is coated on an image bearing member to easily remove filmed materials. When a lubricant is coated on an image bearing member, cleaning performance is improved. However, a slight amount of the toner and the external additive slips through, together with the lubricant, during the repeatedly performed image forming processes. Therefore, the abrasion of the cleaning blade is significant and the life thereof maybe shortened. Furthermore, the lubricant itself may become a binder to the external additives depending on the amount of the lubricant, which causes filming. Furthermore, the lubricant coated on the image bearing member may contaminate other processing devices, resulting in the deterioration of the function thereof.

JOP 2000-75527 describes a technology in which a lubricant is internally or externally added to a toner to improve the cleaning performance and the transfer efficiency. However, in this technology, the coating state and the coating amount of the lubricant on an image bearing member tend to vary depending on image ratio. When the image ratio is low, poor cleaning performance and filming tend to occur.

JOP 2005-62830 describes a technology in which cleaning performance is improved by applying a lubricant material to the surface layer of an image bearing member to reduce a friction coefficient thereof. In this technology, fluorine resin particulates are contained in the surface of the image bearing member and the friction charge thereof ranges from 0.2 to 0.3. However, in the typical contact conditions of a cleaning blade, a soft lubricant material is contained in the surface layer of an image bearing member and therefore, the image bearing member tends to be abraded. The durability of the image bearing member is a problem under such blade contact conditions.

To solve the drawbacks mentioned above, JOP H11-327191 describes a technology of reducing the amount of abrasion by using an image bearing member having a low friction coefficient ($\mu$=0.4 to 0.6) to which a fluorine resin, etc. are added under the condition of reduced blade contact pressure (from 5 to 15 g/cm). However, JOP H11-327391 also describes that this technology involves a problem in that a toner may not be removed from the image bearing member having such a low friction coefficient ($\mu$=0.4 to 0.6) under such a low contact pressure.

As described above, as to the cleaning technology using a cleaning blade for a polymerized toner having a small particle diameter, the performance of an image forming apparatus and its corresponding method and process cartridge is not satisfactory in terms of a combination of cleaning performance, anti-filming, and life length of an image bearing member and a cleaning blade.

The blade contact pressure is typically from 20 to 40 g/cm to have a margin for the cleaning performance in consideration of the fluctuation of the rubber physicality of a blade according to the temperature change and the surface property of an image bearing member. However, as a result of an intensive study by the present inventor, in the blade cleaning using an image bearing member having a friction coefficient of from 0.1 to 0.3 and a polymerized toner having a small particle diameter, it is found that it is possible to reduce the blade contact pressure without sacrificing cleaning performance when the blade condition is set in such a manner that a torque rises during removal of the remaining toner. Therefore, it is possible to elongate the life of an image bearing member and a cleaning blade. It is also found that it is possible to make the rotation torque of an image bearing member low, which leads to reduction of the power consumption and provide an image forming apparatus which can maintain a good cleaning performance over an extended period of time.

SUMMARY OF THE INVENTION

Because of these reasons, the present inventor recognizes that a need exists for an image forming apparatus having a long durability and maintaining good cleaning performance over repetitive image formation for an extended period of time without causing filming on an image bearing member, and a corresponding image forming method and process cartridge.

Accordingly, an object of the present invention is to provide an image forming apparatus having a long durability and maintaining good cleaning performance over repetitive image formation for an extended period of time without causing filming on an image bearing member, and a corresponding image forming method and process cartridge. Briefly this object and other objects of the present invention as hereinafter described will become more readily apparent and can be attained, either individually or in combination thereof, by an image forming apparatus including an image bearing member configured to bear a latent electrostatic image, a latent electrostatic image forming device configured to form the latent electrostatic image on the image bearing member, a developing device configured to develop and visualize the latent electrostatic image on the image bearing member with a toner, a transfer device configured to transfer the visualized toner image to a recording medium, a cleaning device including a cleaning blade configured to contact a surface of the image bearing member so as to remove the toner remaining thereon. The static friction coefficient μ of the image bearing member ranges from 0.1 to 0.3, a contact pressure of the cleaning blade to the image bearing member ranges from 1.5 to 10 g/cm, and the image bearing member and the cleaning blade satisfy the following relationships (1) and (2):

$$0.01\ (\text{kg}) \leqq (T_{off}-T_0)/r \leqq 0.15\ (\text{kg}) \qquad \text{Relationship (1)}$$

$$1.2 \leqq (T_{on}-T_0)/(T_{off}-T_0) \leqq 3.8. \qquad \text{Relationship (2)}$$

In the relationships (1) and (2), $T_0$ represents the rotation torque (kgcm) of the image bearing member when the cleaning blade is not in contact with the surface of the image bearing member, $T_{off}$ represents the rotation torque (kgcm) of the image bearing member when the cleaning blade is brought into contact with the surface of the image bearing member and the toner is not used for development on the surface of the image bearing member, $T_{on}$ represents the rotation torque (kgcm) of the image bearing member when the cleaning blade is brought into It is still further preferred that, in the image forming apparatus mentioned above, the image bearing member includes a substrate and a photosensitive layer on the substrate.

It is still further preferred that, in the image forming apparatus mentioned above, the photosensitive layer is single-layered and forms the uppermost layer.

It is still further preferred that, in the image forming apparatus mentioned above, the photosensitive layer forms the uppermost layer and includes a charge generating layer and a charge transport layer disposed on the charge generating layer.

It is still further preferred that, in the image forming apparatus mentioned above, the image bearing member further includes a protective layer, which is disposed on the photosensitive layer and forms the uppermost layer.

It is still further preferred that the image forming apparatus mentioned above includes a plurality of the image bearing members, the latent electrostatic image forming devices, the developing devices, and the transfer devices.

It is still further preferred that, in the image forming apparatus mentioned above, the transfer device includes an intermediate transfer body to which the visualized toner image formed on the image bearing member is primarily transferred and a secondary transfer device to secondarily transfer the visualized image borne on the intermediate transfer body to the recording medium.

It is still further preferred that, in the image forming apparatus mentioned above, the toner is a polymerized toner.

It is still further preferred that, in the image forming apparatus mentioned above, the toner has a volume average particle diameter that ranges from 3 to 8 μm, and an average circularity not less than 0.95.

As another aspect of the present invention, an image forming method is provided which includes forming a latent electrostatic image on an image bearing member;

developing the latent electrostatic image with a toner to form a visualized image;

transferring the visualized image to a recording medium; and removing the toner remaining on a surface of the image bearing member by contacting a cleaning blade therewith, wherein a static friction coefficient μ of the image bearing member ranges from 0.1 to 0.3, a contact pressure of the cleaning blade to the image bearing member ranges from 1.5 to 10 g/cm, and the image bearing member and the cleaning blade satisfy the following relationships (1) and (2):

$$0.01\ (\text{kg}) \leqq (T_{off}-T_0)/r \leqq 0.15\ (\text{kg}) \qquad \text{Relationship (1)}$$

$$1.2 \leqq (T_{on}-T_0)/(T_{off}-T_0) \leqq 3.8. \qquad \text{Relationship (2)}$$

In the relationships (1) and (2), $T_0$ represents the rotation torque (kgcm) of the image bearing member when the cleaning blade is not in contact with the surface of the image bearing member, $T_{off}$ represents the rotation torque (kgcm) of the image bearing member when the cleaning blade is brought into contact with the surface of the image bearing member and the toner is not used for development on the surface of the image bearing member, $T_{on}$ represents the rotation torque (kgcm) of the image bearing member when the cleaning blade is brought into contact with the surface of the image bearing member and the toner is used for development on the surface of the image bearing member, and r represents a radius of the image bearing member.

As another aspect of the present invention, a process cartridge is provided which includes an image bearing member configured to bear a latent electrostatic image, at least one device selected from the group including a charging device configured to charge the image bearing member, a developing device configured to develop the latent electrostatic image with a toner, a transfer device configured to transfer the developed image to a recording medium and a discharging device, and a cleaning device including a cleaning blade to remove a toner remaining on the surface of the image bearing member by contacting the cleaning blade therewith. The process cartridge is configured to be detachably attached to an image forming apparatus and a static friction coefficient μ of the image bearing member ranges from 0.1 to 0.3, the contact pressure of the cleaning blade to the image bearing member ranges from 1.5 to 10 g/cm, and the image bearing member and the cleaning blade satisfy the following relationships (1) and (2):

$$0.01\ \text{kg} \leqq (T_{off}-T_0)/r \leqq 0.15\ (\text{kg}) \qquad \text{Relationship (1)}$$

$$1.2 \leqq (T_{on}-T_0)/(T_{off}-T_0) \leqq 3.8. \qquad \text{Relationship (2)}$$

In the relationships (1) and (2), $T_0$ represents the rotation torque (kgcm) of the image bearing member when the cleaning blade is not in contact with the surface of the image bearing member, $T_{off}$ represents the rotation torque (kgcm) of the image bearing member when the cleaning blade is brought into contact with the surface of the image bearing member and the toner is not used for development on the surface of the image bearing member, $T_{on}$ represents the rotation torque (kgcm) of the image bearing member when the cleaning blade is brought into contact with the surface of the image bearing member and the toner is used for development on the surface of the image bearing member, and r represents a radius of the image bearing member.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
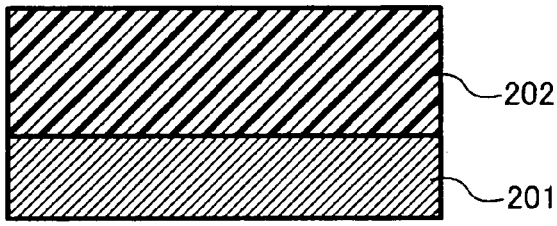
FIG. 1 is a schematic diagram illustrating an example of the layer structure of the image bearing member for use in a non-limiting embodiment of the image forming apparatus of the present invention.

In the image forming apparatus of a non-limiting embodiment of the present invention, when the blade contact pressure is reduced to an unpredictably small level (e.g., 1.5 to 10 g/cm), which is excessively small in comparison with a typical case, a polymerized toner having a small particle diameter can be removed over an extended period of time. In addition, since the blade contact pressure can be reduced to an extremely small level, the abrasion amount of an image bearing member and a cleaning blade during cleaning can be drastically reduced, which leads to an elongation of the life thereof.

The reasons the abrasion of an image bearing member and a blade edge can be restrained, good cleaning performance can be maintained and filming can be blocked are deduced as follows based on the result obtained in the process of reaching the present invention.

When the rotation torque of an image bearing member during image formation satisfies the relationship: $1.2 \leqq (T_{on}-T_0)/(T_{off}-T_0) \leqq 3.8$ and a good blade cleaning performance is maintained, energy is consumed to scrape the remaining toner off on an image bearing member after image formation. As a result, the rotation torque of the image bearing member physically increases. Next, reducing the blade contacting pressure during non-image formation to 1.5 to 10 g/cm to make the rotation torque of an image bearing member satisfy the following relationship: $0.01\ (\text{kg}) \leqq (T_{off}-T_0)/r \leqq 0.15\ (\text{kg})$ represents the condition in which the energy is not used in a wasteful manner during abrasion of the image bearing member by a cleaning blade. This is considered to lead to a reduction of the amount of abrasion of the image bearing member and the blade. Further, it is found that when these conditions are combined with the friction coefficient of the image bearing member of from 0.1 to 0.3, the drawbacks can be solved by the present invention.

An image bearing member having a low friction coefficient naturally has a good releasability. It is therefore considered that significant anti-filming effect can be obtained from the synergy effect of a low contact pressure of a blade and good releasability. Especially, an image bearing member having such a low friction coefficient tends to be easily scraped since the surface layer thereof contains a soft lubricant material. The improvement on the durability of an image bearing member by devices included therein is limited. However, it is found that it is possible to drastically improve the durability by taking the structure of the present invention as described in the non-limiting Examples discussed below.

Further, with regard to filming, since the blade contact pressure is small, toner is not unnecessarily pressed against an image bearing member and a blade edge at the contact portion thereof. This is considered to be a factor of preventing the occurrence of filming. In this filming prevention mechanism, the surface of an image bearing member is cleaned under the minimum contact pressure at which toner is held (i.e., not slipped through). That is, filmed materials are not pressed against an image bearing member and a cleaning blade by an excessive force. Thereby, the filming is prevented.

When an image forming apparatus adopting a blade cleaning system takes the structure of the present invention, the image forming apparatus and its corresponding process cartridge can maintain a good cleaning performance without causing filming on the surface of the image bearing member during repetitive image formation for an extended period of time.

In addition, this image forming apparatus dispenses with a typical application mechanism so that the image forming apparatus can be of a compact-size. Further, since the rotation torque of the image bearing member is small, it is possible to reduce the power consumption especially in a four tandem type color image forming apparatus.

Non-limiting embodiments of the present invention will be now described below, in detail, with reference to several embodiments and accompanying drawings.

Image Forming Apparatus and Image Forming Method

The image forming apparatus of an embodiment of the present invention includes at least an image bearing member, a latent electrostatic image forming device, a developing device, a transfer device and a cleaning device. Other devices such as a fixing device, a discharging device, a recycling device and a control device can be optionally included therein if desired.

An embodiment of the image forming method of the present invention includes at least a latent electrostatic image forming process, a developing process, a transfer process and a cleaning process. Other processes such as a fixing process, a discharging process, a recycling process and a control process are optionally included therein if desired.

An embodiment of the image forming method of the present invention can be suitably performed by the image forming apparatus of the present invention. The latent electrostatic image forming process can be performed by the latent electrostatic image forming device. The developing process can be performed by the developing device. The cleaning process is performed by the cleaning device. The other processes can be performed by the corresponding other devices.

Latent Electrostatic Image Forming Process and Latent Electrostatic Image Forming Device The latent electrostatic image forming process is a process in which a latent electrostatic image is formed on an image bearing member.

The image bearing member includes a substrate, a photosensitive layer thereon, and optionally a protective layer, etc., if desired.

In one embodiment, the image bearing member includes a substrate, a single layer type photosensitive layer on the substrate, a protective layer, and optionally other layers such as an intermediate layer and an undercoating layer if desired.

In another embodiment, the image bearing member includes a substrate, a layered photosensitive layer including a charge generating layer and a charge transport layer, a protective layer and optionally other layers such as an intermediate layer and an undercoating layer. In this embodiment, the charge generating layer can be accumulated on the charge transport layer in this order and vice versa.

Figure 2:
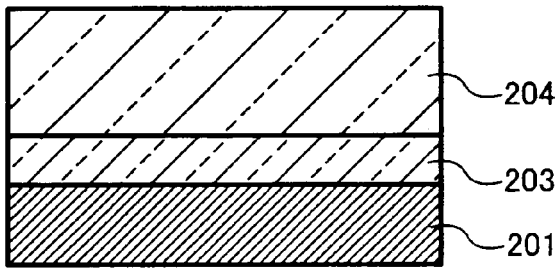
FIG. 2 is a schematic diagram illustrating another example of the layer structure of the image bearing member for use in a non-limiting embodiment of the image forming apparatus of the present invention.
Figure 3:
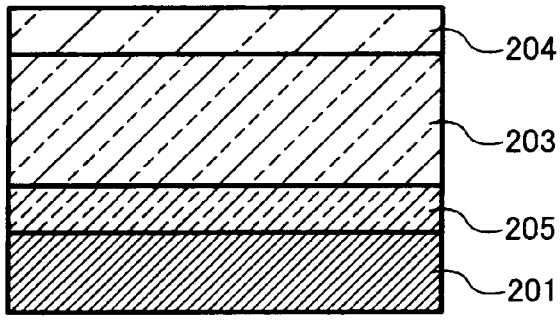
FIG. 3 is a schematic diagram illustrating another example of the layer structure of the image bearing member for use in a non-limiting embodiment of the image forming apparatus of the present invention.
Figure 4:
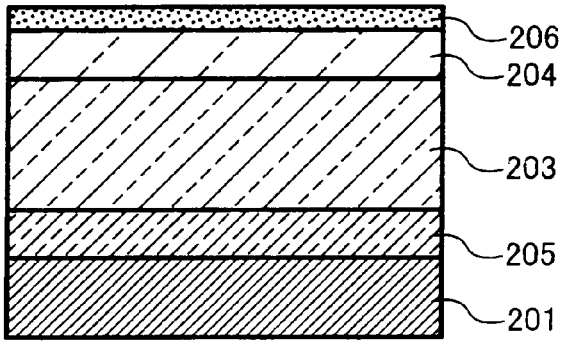
FIG. 4 is a schematic diagram illustrating another example of the layer structure of the image bearing member for use in a non-limiting embodiment of the image forming apparatus of the present invention.

FIG. 1 is a schematic diagram illustrating an example of the image bearing member of the present invention, in which a photosensitive layer 202 is provide on a substrate 201. In addition, FIGS. 2 to 4 are schematic diagrams illustrating other examples of the layer structure of the image bearing member of the present invention. The example illustrated in FIG. 2 is a function separating type, in which the photosensitive layer includes a charge generating layer (CGL) 203 and a charge transport layer (CTL) 204. In FIG. 3, there is provided an undercoating layer 205 between the substrate 201 and the function separating photosensitive layer. In FIG. 4, a protective layer 206 is provided on the charge transport layer (CGL) 204. The image bearing member of the present invention includes at least the substrate 201 and the photosensitive layer 202. Other layers and the type of the photosensitive layer can be optionally combined therein.

The static friction coefficient (μ) of the image bearing member is preferably from 0.1 to 0.3. When the static friction coefficient (μ) is too large, the range of good cleanability of a cleaning blade is limited, which leads to difficulty in reducing the blade contact pressure. As a result, the abrasion amount of the image bearing member and the cleaning blade may increase. When the static friction coefficient (μ) is too small, the attachment force between a toner and the image bearing member decreases so that it is difficult to retain the toner used for development on the image bearing member, which may lead to a decrease of image definition and density.

The static friction coefficient (μ) of the image bearing member can be measured by an Oiler belt system as described in JOP H09-166919.

In the image bearing member mentioned above, when the uppermost (i.e., surface) layer contains fluorine resin particulates (including primary particles and secondary particles) and the average diameter of the projected image of the fluorine resin particulates on the surface layer is represented by D, it is preferred that the following relationship: $0.15\ \mu m \leqq D \leqq 3\ \mu m$ is satisfied. In addition, the total area of the projected image of the fluorine resin particulates occupying the surface layer is not less than 10% based on the total surface area of the surface layer.

The average diameter of the projected image is the average of the inner diameter passing through the center of the gravity of the projected image of a particle (or agglomeration of particles which is regarded as a particle) observed when the surface of the surface layer is substantial vertical. The inner diameter is measured by an increment of two degrees. An image bearing member having a surface layer of such a structure has and maintains an extremely small surface friction coefficient over repetitive use.

When the fluorine resin particulates on the surface layer are abraded by a cleaning blade, the fluorine resin particulates are extended along the direction of abrasion. As a result, the surface portion of the image bearing member where the fluorine resin does not exist is covered therewith. When preferred-sized particles of the fluorine resin are substantially uniformly present in a preferred range, the fluorine particulates can cover almost all of the surface of the image bearing member where the fluorine resin has not been present without increasing the content of the fluorine resin particulates. Thereby, the surface of the image bearing member can almost uniformly have a low friction coefficient all over the surface. Further, when the surface layer is abraded, the fluorine resin particulates present inside the uppermost layer surface so that it is possible to maintain a low friction coefficient over an extended period of time. Consequently, an image forming apparatus including such an image bearing member can maintain a cleanability at a high level and produce quality images without abnormality, such as image flow, for an extended period of time.

When the average particle diameter of the projection image of surfaced portions of the primary particle mentioned above and the secondary particles formed of agglomeration of multiple primary particles is represented by D, and the total area ratio of the projected image of the particles satisfying the relationship: 0.15 μm≦D≦3 μm is less than 10% based on the surface area, the following state is possible.

First, the content of the fluorine resin particulates in the surface layer is small.

Second, most of the surfaced fluorine resin particulates (including secondary particles) are smaller than 0.15 μm.

Third, most of the surfaced fluorine resin particulates are greater than 3 μm.

In the first case, the fluorine resin functioning as a lubricant is not sufficiently present in the surface layer in comparison with a binder resin forming the surface layer. Therefore, the surface of the image bearing member does not maintain a low friction coefficient.

In the second case, when the average particle diameter of the surfaced portion of the fluorine resin is too small, excessively small fluorine resin particles are dispersed on the surface layer. Therefore, the effect of reducing the friction coefficient of the surface layer of the image bearing member may not be sufficient. That is, the contact area between a toner and the primary particle and the secondary particle of the resin fluorine particulates becomes small in a mechanism in which the surface of an image bearing member has a low friction coefficient so that a toner rolls and has a good cleanability. Therefore, the effect of the toner rolling on the surface of the image bearing member reduces friction, which is considered to lead to deterioration of cleaning performance.

In the third case, since a significant number of fluorine resin particles having a large particle diameter (e.g., greater than 3 μm) surfaces on the surface layer, the surface roughness is great as mentioned above, which leads to deterioration of cleaning performance. Further, this causes deterioration of sharpness of latent electrostatic images by scattering of a laser beam and the occurrence of abnormal images due to the decrease of the voltage contrast.

Therefore, when the average diameter of the projected image of the surfaced portion of the fluorine resin particulates is represented by D, the following relationship: 0.15 μm≦D≦3 μm is preferably satisfied and the total area of the projected image of the fluorine resin particulates in the surface of the surface layer is preferably not less than 10% and more preferably from 12 to 50%.

The content of the fluorine resin particulates in the surface layer is preferably from 20 to 60% by volume and more preferably from 21 to 50% by volume. When the content of the fluorine resin is too small, the area ratio of the projected image of the surfaced particulates tends to be small. This may lead to deterioration of the maintainability of a low friction coefficient. When the content of the fluorine resin is too large, the content of the binder resin inevitably decreases. As a result, the mechanical strength of the coated layer may deteriorate.

By limiting the content of the fluorine resin within the range mentioned above and forming the surface layer in such a manner that the secondary particles thereof do not locally exist in the surface layer, even when the surface layer is abraded and scraped, the secondary particles existing inside are sequentially exposed to the surface. Therefore, the area ratio of the projected image occupying on the surface is constantly kept within the preferred range. In addition, the fluorine resin particulates do not excessively exist so that the mechanical strength of the surface layer is also kept within a preferred range. Therefore, deterioration of the anti-abrasion property can be also restrained.

It is preferred that the secondary particles of the fluorine resin particulates in the surface layer of the image bearing member having a particle diameter of from 0.3 to 4 μm, and more preferably from 0.3 to 1.5 μm, covers the surface layer with an area ratio of not less than 10%. Secondary particles that are too large may cause the toner contact area, mentioned above, to be too small and a laser beam to scatter, which leads to the production of abnormal images. To the contrary, excessively small surface cover ratio causes the surface friction coefficient not to be sufficiently low from a micro point of view.

An exemplary method of calculating the average particle diameter and the area ratio of the projected image of the surfaced portion of the fluorine resin particulates is described next. That is, the method of observing the surface layer using a scanning electron microscope (SEM) is described, but the methods of observing exposed fluorine particulates are not limited thereto.

The surface of an image bearing member on which fluorine resin particulates are dispersed is photographed by a SEM and the fluorine resin particulate images displayed in the SEM image is analyzed by an image analyzer. Thereby, the average particle diameter, the number of particles and the area ratio are obtained.

Since the image obtained as an SEM image is projected from substantially vertical direction to the surface, the displayed image of the fluorine resin particulates is also an image projected from the same direction. The average particle diameter of the projected images is the average of the measurement results of the projected image of a particle or an agglomeration of particles which is treated as a particle. The inner diameter of the projected image passing through the center of gravity is measured by an increment of two degrees.

The image analyzer can distinguish the projected image of the fluorine resin particulates and a binder resin therearound in a binary manner. Further, it is preferred for the image analyzer to select conditions in which a secondary particle formed of agglomeration of multiple primary particles can be approximated as a large particle. Furthermore, it is also preferred to have a program which can calculate at least the average particle diameter and the area ratio of each fluorine resin particulate. Such an image analyzer, for example, is a dedicated device such as a high definition image analyzing system, IP-1000 (manufactured by Asahi Engineering Corporation), and a computer in which the image analyzing software (Image-Pro plus, manufactured by Media Cybernetics, Inc.) is installed and used. When an accelerating voltage is high, an SEM image may be obtained as image information including the inside near the surface of the image bearing member. In the system in which fluorine resin particulates are dispersed in a binder resin, fluorine resin particulates existing not on but near the surface may be observed when the accelerating voltage is high. Therefore, it is preferred to adjust the accelerating voltage so that surfaced fluorine resin particulates are displayed.

For example, when a field emission scanning electron microscope (S-4200, manufactured by Hitachi, Ltd.) is used as an SEM, the suitable range of the accelerating voltage ranges from about 2 to about 6 kV. But this range is preferred to be adjusted depending on devices used and materials for use in an image bearing member.

The obtained SEM images are used with an image analyzing software, and the average particle diameter and the area ratio of each fluorine resin particulate counted in an observation area are calculated. Thereby, it is possible to observe the state of the fluorine resin particulates on the surface of an image bearing member.

Specific examples of the fluorine resin particulates include tetrafluoetylene resin particulates, perfluoroalkoxy resin particulates, trifluorochloroethylene resin particulates, hexafluoro ethylene propylene resin particulates, vinyl fluoride resin particulates, vinylidene fluoride resin particulates, fluorodichloro etylene resin particulates, and copolymers thereof. These can be used alone or in combination. Among these, tetrafluoetylene resin particulates and perfluoroalkoxy resin particulates are preferred and the average primary particle diameter thereof is especially preferred to be from 0.1 to 0.3 μm.

The fluorine resin particulates can be dispersed together with at least an organic solvent by a typical method using, for example, an attritor, a sand mill, a vibrating mill or supersonic. Among these, a ball mill, in which impurities are less mingled from outside, or a vibrating mill is preferred in terms of dispersability. It is possible to use any typically-used medium such as zirconia, alumina and agate. Among these, it is especially preferred to use zirconia in terms of the effect on the dispersability of fluorine resin particulates. Combinational use of these dispersion methods may improve the dispersability thereof. In addition, to satisfy the average particle diameter mentioned above of the primary particles and the secondary particles, too excessive a small or large primary particle diameter of the fluorine resin particulates is not preferred. The primary particle diameter is preferably from 0.1 to 10 μm and more preferably from 0.05 to 2.0 μm and is possibly adjusted by the dispersion treatment described later if desired.

In addition, it is possible to add a dispersant to a binder resin to improve the dispersability of the fluorine resin particulates. Specific examples of such dispersants include fluorine containing surface treatment agents, graft polymers, block polymers and coupling agents.

It is possible to add a filler material to the surface layer of an image bearing member to improve the anti-abrasion property thereof. There are two types of fillers, which are an organic filler and an inorganic filler. An inorganic filler is advantageous in terms of improvement on anti-abrasion property. Specific examples of such inorganic fillers include: metal copper powder; metal tin powder; metal aluminum powder; metal indium powder: metal oxides such as tin oxide, zinc oxide, zirconium oxide, indium oxide, antimony oxide, bismuth oxide, calcium oxide, tin oxide doped with antimony and indium oxide doped with tin, metal fluorides such as tin fluoride, calcium fluoride and aluminum fluoride, potassium titanate; and boron nitride.

These fillers can be surface-treated by at least one surface treatment agent. Surface treatment is preferred to improve the dispersability of these fillers. A filler having a low dispersability causes the rise in the residual voltage, the deterioration of transparency, the defect of a formed layer, and the deterioration of anti-abrasion property. This may develop into a large problem of hindering improvement on duration and quality of images. As such a surface treatment agent, any typical surface treatment agents can be used. Among these, surface treatment agents which can maintain the insulation property of a filler are preferred. Specific examples thereof include titanate containing coupling agents, aluminum containing coupling agents, zircoaluminate containing coupling agents, and higher aliphatic acids. Silane coupling agents can be used in combination with these surface treatment agents. Other specific examples of the surface treatment agents include $Al_2O_3$, $TiO_2$, $ZrO_2$, silicon and aluminum stearate. Mixing treatment thereof is more preferred in terms of dispersability of a filler and anti-image blurring. The treatment by a silane coupling agent has an adverse impact in terms of image blurring. But, the mixing treatment of a silane coupling with the above-mentioned surface treatment agents may be effective to restrain the adverse impact.

The amount of the surface treatment agents mentioned above depends on the average primary particle diameter of a filler used, but preferably ranges from 3 to 30 parts by weight and more preferably ranges from 5 to 20 parts by weight. An amount of a surface treatment agent that is too small has an adverse effect on the dispersion effect of a filler. To the contrary, too great an amount thereof may cause a significant rise in the residual voltage.

Layered Photosensitive Layer

As described above, exemplary embodiments of the layered photosensitive layer includes at least a charge generating layer and a charge transport layer thereon, and can optionally include other layers if desired Charge Generating Layer An exemplary charge generating layer includes at least a charge generating material, a binder resin and optionally other components if desired.

There is no specific limit to the selection of the charge generating material. Any charge generating material can be suitably selected. Either of an organic based material and an inorganic based material can be used.

There is no specific limit to the selection of the inorganic based material. Any inorganic material can be suitably selected to purpose. Specific examples thereof include: crystal selenium; amorphous selenium; and compounds of selenium tellurium, selenium tellurium halogen and selenium arsenic.

There is no specific limit to the selection of the organic based materials. Any known material can be suitably selected. Specific examples thereof include: phthalocyanine based pigments such as metal phthalocyanine and non-metal phthalocyanine; azulenium salt pigments; methine squarate pigments; azo pigments having a carbazole skeleton; azo pigments having a triphenyl amine skeleton; azo pigments having a diphenyl amine skeleton; azo pigments having a dibenzothiophen skeleton; azo pigments having a fluorenone skeleton; azo pigments having an oxadiazole skeleton; azo pigments having a bisstilbene skeleton; azo pigments having a distyryl oxadiazole skeleton; azo pigments having a distyryl carbazole skeleton; perylene based pigments; anthraquinone based or polycyclic quinone based pigments; quinone imine based pigments; diphenyl methane or triphenyl methane based pigments; benzoquinone or naphthoquinone based pigments; cyanine and azomethine based pigments; indigoid based pigments; and bisbenzimidazole based pigments. These can be used alone or in combination.

There is no specific limit to the selection of the binder resin mentioned above. Any binder resin can be suitably selected. Specific examples thereof include polyamide resins, polyurethane resins, epoxy resins, polyketone resins, polycarbonate resins, silicone resins, acryl resins, polyvinyl butyral resins, polyvinyl formal resins, polyvinyl ketone resins, polystyrene resins, poly-N-vinyl carbazole resins, polyacrylamide resins. These can be used alone or in combination.

A charge transport material can be optionally added if desired. In addition, other than the binder resins mentioned above, a charge transport polymer can be also added as a binder resin for a charge generating layer.

As a method of forming the charge generating layer, vacuum thin layer forming methods and casting methods from a solution dispersion system can be mentioned.

In the vacuum thin layer forming methods, for example, there are glow discharging polymerization methods, vacuum deposition methods, chemical vacuum deposition (CVD) methods, sputtering methods, reactive sputtering methods, ion plating methods and accelerated ion injection methods. In these vacuum thin layer forming methods, the inorganic based materials and the organic based materials can be suitably used.

To form a charge generating layer by the casting method, it is possible to use a typical method such as a dip coating method, a spray coating method and a beat coating method.

Specific examples of organic solvents for use in forming a liquid application for a charge generating layer include acetone, methyl ethylketone, methyl itopropylketone, cyclohexanone, benzene, toluene, xylene, chloroform, dichloromethane, dichloroethane, dichloropropane, trichloroethane, trichloroethylene, tetrachloroethane, tetrahydrofuran, dioxolane, dioxane, methanol, ethanol, isopropylalcohol, butanol, ethyl acetate, butyl acetate, dimethyl sulfoxide, methyl cellosolve, ethyl cellosolve, and propyl cellosolve. These can be used alone or in combination.

Among these, tetrahydrofuran, methyl ethylketone, dichloromethane, methanol and ethanol, which have a boiling point of from 40 to 80° C., are especially preferred because drying after their coating is easy.

The liquid application for forming a charge generating layer is prepared by dispersing and dissolving the charge generating material and the binder resin in the organic solvent. As a method of dispersing an organic pigment in an organic solvent, there are a dispersion method using a dispersion medium such as a ball mill, a bead mill, a sand mill and a vibration mill, and a high speed liquid collision dispersion method.

The electrophotographic characteristics, especially photosensitivity, vary depending on the thickness of the charge generating layer. In general, as the layer thickens, the photosensitivity becomes high. Therefore, it is preferred to set the layer thickness of the charge generating layer in a suitable range according to the specification of a desired image forming apparatus. To obtain the sensitivity suitable as an image bearing member, the layer thickness thereof is preferably from 0.01 to 5 μm and more preferably from 0.05 to 2 μm.

Charge Transport Layer

The charge transport layer is a layer for retaining electrification charges and moving charges generated and separated in the charge generating layer by irradiation of light to combine with the retained electrification charges. To achieve the objective of retaining electrification charges, the charge transport layer is desired to have a high electric resistance. To achieve the objective of obtaining a high surface voltage by the retained electrification charges, the retained electrification charges are desired to have a low dielectric constant and a good charge mobility.

The charge transport layer contains a charge transport layer and a binder resin. Other components can be optionally contained therein.

Further, when the charge transport layer forms the surface layer of an image bearing member, the charge transport layer contains at least fluorine resin particulates.

When fluorine resin particulates are contained in a charge transport layer, it is preferred to increase the content thereof near the surface of the charge transport layer to efficiently obtain the effect of reducing a friction coefficient of the surface of an image bearing member. That is, it is fluorine resin particulates on the surface of an image bearing member that mainly reduces the friction coefficient thereof. Therefore, the fluorine resin particulates are desired to be contained at the position in the surface layer on or above the minimum thickness at which the image bearing member can suitably function while the charge transport layer is abraded during repetitive use. It is wasteful to contain the fluorine resin particulates contained below the minimum thickness. What is even worse, the fluorine resin particulates contained below the minimum thickness may have an adverse impact on the electrophotographic characteristics of an image bearing member. As a method of manufacturing an image bearing member having fluorine resin particulates near the surface of a charge transport layer in a concentrated manner, for example, there is a method in which a liquid of application for forming a charge transport layer not containing fluorine resin particulates is coated before a liquid application for forming a charge transport layer containing fluorine resin particulates is coated. To be specific, a first charge transport layer is formed using a liquid application for forming a charge transport layer not containing fluorine and a second charge transport layer is formed on the first charge transport layer using a liquid application for forming a charge transport layer containing fluorine resin particulates. Subsequent to drying, a charge transport layer containing fluorine resin particulates on or near the surface thereof is obtained.

Specific examples of the charge transport material include positive hole carrier transport materials (electron donating materials), electron transport materials (electron accepting materials), and charge transport polymers.

Specific examples of the electron transport material (electron accepting materials) include chloranil, bromanil, tetracyanoethylene, tetracyanoquino dimethane, 2,4,7-trinitro-9-fulorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophen-5,5-dioxide. These can be used alone or in combination.

Specific examples of the positive hole carrier transport materials (electron donating materials) include oxazole derivatives, oxadiazole derivatives, imidazole derivatives, triphenyl amine derivatives, 9-(p-diethylaminostyryl anthracene), 1,1-bis-(4-dibenzyl aminophenyl)propane, styrylanthracene, styrylpyrazoline, phenylhydrazones, α-phenylstilbene derivatives, thiazole derivatives, triazole derivatives, phenazine derivatives, acridine derivatives, benzfuran derivatives, benzimidazole derivatives and thiophen derivatives. These can be used alone or in combination.

Specific examples of the charge transport polymers include compounds having the following structure.

(a) Specific examples of polymers having a carbazole ring include poly-N-vinylcarbazole, and the compounds described in JOPs S54-9632, S54-11737, H04-175337, H04-183719 and H06-234841.

(b) Specific examples of polymers having a hydrazone structure include the polymers described in JOPs S57-78402, S61-20953, S61-296358, H01-134456, H01-179164, H03-180851, H03-180852, H03-50555, H05-310904 and H06-234840.

(c) Specific examples of polysilylenes include polymers described in JOPs S63-285552, H01-88461, H04-264130, H04-264131, H04-264132, H04-264133 and H04-289867.

(d) Specific examples of polymers having a triarylamine structure include N,N,bis(4-methylphenyl)-4-aminopolystyrene, polymers described in JOPs H01-134457, H02-282264,H02-304456,H04-133065, H04-133066, H05-40350, and H05-202135.

(e) Specific examples of other polymers include a condensation polymerized formaldehyde compound of nitropropylene, polymers described in JOPs S56-150749, H06-234836 and H06-234837.

In addition, there are other examples of the charge transport polymers, which are, for example, polycarbonate resins having a triaryl amine structure, polyurethane resins having a triaryl amine structure, polyester resins having a triaryl amine structure and polyether resins having a triaryl amine structure. Specific examples thereof include polymers described in JOPs S64-1728, S64-13061, S64-19049, H04-11627, H04-225014, H04-230767, H04-320420, H05-232727, H07-56374, H09-127713, H09-222740, H09-265197, H09-211877 and H09-304956.

Other than the polymers mentioned above, copolymers, block polymers, graft polymers and star polymers with a known monomer, and cross-linking polymers having the electron donating groups described in JOP H03-109406 can be used as the polymers having an electron donating group.

Specific examples of the binder resins include polycarbonate resins, polyester resins, methacryl resins, acryl resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinylcarbazole resins, polyvinyl butyral resins, polyvinyl formal resins, polyacrylate resins, polyacryl amide resins and phenoxy resins. These can be used alone or in combination.

The charge transport layer can also contain a copolymer of a cross-linking binder resin and a cross-linking charge transport material.

The charge transport layer can be formed by dissolving or dispersing these charge transport materials and the binder resins in a suitable solvent followed by coating and drying. The charge transport layer can optionally contain additives such as a plasticizing agent, an anti-oxidizing agent and a leveling agent in a suitable amount if desired.

The layer thickness of the charge transport layer preferably ranges from 5 to 100 μm. The layer thickness of a charge transport layer has been thinned to satisfy the demand for improving the quality of images in recent years. It is preferred that the charge transport layer has a thickness that ranges from 5 to 30 μm for a high definition of 1,200 dpi or higher.

Single Layered Photosensitive Layer

The exemplary single layer photosensitive layer mentioned above contains a charge generating material, a charge transport material, a binder resin and other optional components.

The materials for use in the layered photosensitive layer can be used as the charge generating materials, the charge transport materials and the binder resins for the single layered photosensitive layer.

Further, when the single layer photosensitive layer forms the surface layer of an image bearing member, the single layer photosensitive layer contains at least fluorine resin particulates and at least one of organic particulates selected from the group consisting of silicon oxides, titanium oxides and aluminum oxides.

Thereby, the same effect can be obtained as in the case of the charge transport layer mentioned above.

In addition, as in the case of the charge transport layer, it is preferred that fluorine resin particulates are contained near the surface of a single layer photosensitive layer in a concentrated manner and the single layer photosensitive layer can be manufactured in the same manner mentioned above.

A single layer photosensitive layer can be formed by a casting method. In most cases, a single layer photosensitive layer can be formed by dissolving or dispersing a charge generating material, a low molecular weight charge transport material and a charge transport material polymer in a suitable solvent followed by coating and drying. A plasticizer and a binder resin can be optionally contained therein. The binder resin for use in the charge transport layer can be used or mixed with the binder resins for use in the charge generating layer.

The thickness of the single layer photosensitive layer is preferably from 5 to 100 μm and more preferably from 5 to 50 μm. An excessively thin layer may degrade the chargeability of the single layer photosensitive layer and an excessively thick layer may damage the sensitivity thereof.

Protective Layer

It is preferred that the image bearing member has a protective layer on the photosensitive layer mentioned above. Specific examples of the protective layer include ABS resins, ACS resins, olefin-vinyl monomer copolymers, chlorinated polyethers, aryl resins, phenol resins, polyacetal resins, polyamide resins, polyamideimide resins, polyacrylate resins, polyallylsulfon resins, polybutylene resins, polybutylene terephthalate resins, polycarbonate resins and epoxy resins.

When the protective layer is used, the protective layer forms the surface of an image bearing member. Therefore, fluorine resin particles are contained therein. The protection layer has a purpose of functional separation. In an embodiment of the present invention, the friction coefficient of the protective layer can be kept low during repetitive use for an extended period of time by containing fluorine resin particulates in a suitable dispersion state. Therefore, the anti-abrasion property of the protective layer is improved. Further, since the protective layer is relatively thinly formed on a photosensitive layer, the protective layer has a relatively small impact on the electric characteristics of an image bearing member. Therefore, it is possible for the protective layer to have a relatively large content in comparison with the case of when fluorine resin particles are contained in a charge transport layer. Also, the protective layer containing fluorine resin particulates is advantageous in that the protective layer can be formed by using a recipe dedicated for making the friction coefficient low and improving anti-abrasion property. Thereby, the functions thereof can be distinguishably separated from those of a charge transport layer.

In addition, containing a charge transport material in the protective layer is extremely useful in terms of the electric characteristics of an image bearing member, especially restraining the deterioration of the photosensitivity and the rise in the residual voltage during repetitive use. This is considered to be because charges can be easily moved to the surface of an image bearing member due to the charge transport material contained in the protective layer. As such a charge transport material, it is possible to use the charge transport materials for use in the charge transport layer mentioned above.

Further, the protective layer can optionally contain various kinds of additives to improve adhesiveness, smoothness and chemical stability.

The protective layer can be formed on a photosensitive layer by a typical coating method such as a dip coating method, a spray coating method, a blade coating method and a knife coating method. Among these, the dip coating method and the spray coating method are especially preferred in terms of mass productivity and the quality of a coated film.

However, the dispersion state of fluorine resin particulates in the surface of an image bearing member varies depending on various kinds of coating conditions. Therefore, it is extremely important to set the coating conditions. For example, in the spray coating method, there are coating conditions such as the solid portion density and the kind and the mixing ratio of when mixed solvents are used. Further, there are conditions for a spraying device such as the discharged amount of liquid of application, the air pressure of atomization, the distance between the end of the spray and the surface to be coated, the moving speed of the surface to be coated and the number of coating times. For example, when the discharged amount of liquid of application is decreased and the number of coating times is increased to form a protective layer having a desired thickness, the layer is formed in a relatively dry state. To the contrary, when the discharged amount of liquid of application is increased and the number of coating times is decreased, the layer is formed in a relatively wet state. Therefore, even one state during coating may have an impact on the state of fluorine resin particulates in the surface. Therefore, it is desired to study the various coating conditions and determine a suitable range in which the fluorine resin particulates achieve the state described in the present invention.

The thickness of the protective layer preferably ranges from 0.1 to 15 μm and more preferably ranges from 1 to 10 μm.

Substrate

There is no specific limit to the selection of materials for use in the substrate mentioned above as long as the materials are electroconductive. Any material can be suitably selected. For example, an electroconductive body or an electroconductively-treated insulating body are suitably used. Specific examples thereof include: metals such as Al, Ni, Fe, Cu, Au, and alloys thereof; materials in which a thin layer of a metal such as Al, Ag and Au; or an electroconductive material such as $In_2O_3$ and $SnO_2$ is formed on an insulating substrate such as polyester, polycarbonate, polyimide and glass; resin substrates to which electroconductivity is added by uniformly dispersing carbon black, graphite, metal powder formed of Al, Cu and Ni and electroconductive glass powder in a resin to impart electroconductivity; and electroconductively-treated paper.

There is no specific limit to the form and the size of the substrate. A plate form, a drum form or a belt form substrate can be used. When a substrate having a belt form is used, devices such as a driving roller and a driven roller are desired to be provided. Therefore, the apparatus using such a substrate is increased in size, but there is a merit in that the layout latitude increases. When a protective layer is formed, the flexibility thereof is insufficient, which leads to the possibility of cracking on the surface. This may cause the background fouling to appear granular. Therefore, a drum having a high rigidity is preferred as the substrate.

An undercoating layer can be optionally provided between the substrate and the photosensitive layer if desired. The undercoating layer is provided to improve the adhesive property, prevent the occurrence of moiré, improve the coating property of a layer provided thereon, reduce the residual voltage, etc.

Typically, the undercoating resins are mainly formed of a resin. Considering that a solvent is coated on the resin for forming a photosensitive layer, it is preferred that the resin is hardly soluble in a typical organic solvent.

Specific examples of the resins include water-soluble resins such as polyvinyl alcohol, casein and sodium polyacrylate, alcohol-soluble resins such as copolymerized nylon, and methoxymethylated nylon, curing resins forming three-dimensional structure such as polyurethane, melamine resins, alkyd-melamine resins and epoxy resins.

In addition, fine powder of metal oxides such as titanium oxide, silica, alumina, zirconium oxide, tin oxide and indium oxide, metal sulfides and metal nitrides can be optionally added. Such an undercoating layer can be formed by a typical method using a suitable solvent.

An undercoating layer can be formed by anodizing a metal oxide layer of $Al_2O_3$ formed by a sol-gel process, etc. or by coating organic compounds such as a polyparaxylyene (parylene) or an inorganic compound such as $Sn_2$, $TiO_2$, ITO, and $CeO_2$ using a silane coupling agent, a titanium coupling agent, and a chromium coupling agent by a vacuum thin layer forming method.

There is no specific limit to the layer thickness of such an undercoating layer. The layer thickness thereof can be determined to a suitable purpose and preferably ranges from 0.1 to 10 μm, and more preferably ranges from 1 to 5 μm.

In the image bearing member, an intermediate layer can be optionally provided on a substrate to improve the adhesiveness and the charge blocking property if desired. The intermediate layer is mainly formed of a resin. Considering that a solvent is coated on the resin for forming a photosensitive layer, it is preferred that the resin is hardly soluble in a typical organic solvent.

Specific examples of the resins include: water-soluble resins such as polyvinyl alcohol, casein and sodium polyacrylate, alcohol-soluble resins such as copolymerized nylon, and methoxymethilated nylon; curing resins forming three-dimensional structure such as polyurethane, melamine resins, and alkyd-melamine resins; and epoxy resins.

Typical coating methods are adopted as methods of forming an intermediate layer. The layer thickness of an intermediate layer preferably ranges from about 0.05 to 2 μm.

The latent electrostatic images mentioned above are formed by, for example, uniformly charging the surface of an image bearing member and irradiating the image bearing member imagewise using a latent electrostatic image forming device.

The latent electrostatic image forming device includes, for example, at least a charging device to uniformly charge the surface of an image bearing member and an irradiating device to irradiate the surface of the image bearing member imagewise.

The charging can be performed by, for example, applying a voltage to the surface of an image bearing member using the charging device.

There is no specific limit to the selection of the charging device. Any charging device can be selected. For example, a known contact-type charging device including an electroconductive or semi-conductive roll, brush, film, rubber blade, a non contact-type charging device using corona charging (such as corotron and scorotron) can be used as the charging device.

The irradiating can be performed by irradiating the surface of an image bearing member imagewise using an irradiating device.

There is no specific limit to the selection of such an irradiating device as long as the irradiating device can irradiate imagewise the surface of an image bearing member charged by an charging device. Specific examples thereof include various kinds of irradiating devices such as photocopying optical systems, rod-lens array systems, laser optical systems, and liquid crystal shutter optical systems.

Embodiments of the present invention can adopt a dorsal irradiating system in which the image bearing member is irradiated imagewise from the rear side thereof.

Developing Process and Developing Device

The developing process mentioned above is a process of visualizing a latent electrostatic image by using a toner or a developer for development.

Toner

There is no specific limit to the preparation method or the material of the toner. It is possible to select any known method and material. It is preferred that the toner has a substantially sphere form with a small particle diameter. As methods of forming such a toner, as described in No. 1 of Vol. 43 of Journal of the Imaging Society of Japan (published in 2004, and hereby incorporated by reference), etc., there are methods such as pulverization and classification methods described and suspension polymerization methods, emulsification polymerization methods and polymer suspension methods, in which an oil phase is emulsified, suspended and/or agglomerated in an aqueous medium to form mother toner particles. Especially, a polymerized toner is preferred The pulverization method is a method of preparing mother toner particles by melting, mixing, pulverizing and classifying toner components. In the pulverization method, it is possible to control the forms of the obtained mother toner articles by applying a mechanical impact thereto. The mechanical impact can be imparted to the mother toner particles using a device such as a hybridizer and a mechanofusion.

The suspension polymerization method is a method in which a colorant, a release agent, etc. are dispersed in an oil soluble polymerization initiator and a polymeric monomer and the obtained oil phase are emulsified and dispersed in an aqueous medium containing a surface active agent and other solid dispersants by an emulsification method, which is described later. After the resultant is subject to polymerization reaction and granulated, inorganic particulates can be attached to the surface of toner particles. It is preferred that the inorganic particulates are attached after washing and removing agents.

Specific examples of the polymeric monomers mentioned above include: acids such as acrylic acid, methacrylic acid, α-cyanoacrylic acid, α-cyanomethacrylic acid, itaconic acid, crotonic acid, fumaric acid, and maleic acid or maleic anhydride; amides such as acrylic amide, methcrylic amide, diacetone acrylic amide and their methylol compounds; and acrylates and methacrylates having an amino group such as vinylpyridine, vinylpyrolidone, vinyl imidazole, ethylene imine and dimethylaminoethyl methacrylate. The functional group can be imparted to the surface of toner particles by partially mingling these polymeric monomers.

In addition, when a dispersant having an acid group or base group is selected and used, it is possible to attach a dispersant to the surface of toner particles to introduce a functional group thereto.

In the emulsification polymerization method, an emulsion is synthesized by a typical emulsification polymerization method including emulsifying a polymeric monomer in water containing an active surface agent and a water soluble polymerization initiator. A toner is obtained by mixing the emulsion with a dispersion body in which a colorant, a release agent, etc., are dispersed in an aqueous medium and agglomerating the resultant to the toner particle size by heating and fusing. Thereafter, inorganic particulates can be attached to the toner. Functional groups can be introduced to the surface of toner particles when the monomers mentioned above for use in the suspension polymerization method are used as those for the emulsion.

The solution of the toner components are prepared by dissolving the toner component in a solvent and the liquid dispersant of the toner component is prepared by dispersing the toner component in a solvent.

The toner component contains at least an active hydrogen group containing compound and a polymer reactive therewith, a binder resin, a release agent and a colorant and optionally other component such as resin particulates and a charge control agent.

Among these, the method of emulsifying and/or dispersing a solution or a liquid dispersion of a toner component in an aqueous medium to granulate toner particles is preferred to prepare the toner considering that its wide selection of a resin, high low temperature fixability, good granularity, and easy controlling of particle diameters, particle size distribution and forms.

The toner has a volume average particle diameter ranging from 3 to 8 μm, and more preferably ranging from 3 to 6 μm. When the volume average particle diameter is too small, the ratio of too fine toner particles by which abnormal images easily occur may become great. A volume average particle diameter that is too large tends to have difficulty in satisfying the demand for improving the quality of electrophotographic images.

The volume average particle diameter can be measured by, for example, a particle size measuring device "COULTER COUNTER TAII", manufactured by Beckman Coulter Inc.

The average circularity of the toner is preferably not less than 0.95, and more preferably not less than 0.98. When the average circularity is not less than 0.95, the developability and the transferability are improved and quality images are easily obtained.

The average circularity of the toner can be measured by, for example, an optical detection band method in which images of particles contained in a suspension passing through an imaging detection band on a plate are optically detected and analyzed with a charge coupled device (CCD). For example, a flow type particle image analyzer FPIA-2100 (manufactured by Sysmex Corporation) can be used.

Developer

The developer mentioned above contains the toner and other optionally selected components, such as a carrier. A single-component developer or two component developer can be used. Two component developers are preferred in terms of the life length when a developer is used in a high speed printer satisfying the demand of improving information processing speed in recent years.

When a single component developer containing the toner is used and replenished, the variance of the toner particle diameters is small. Further, filming of the toner on a developing roller does not occur. Also, the toner is not fused and attached to device members such as a blade to form a thin layer of the toner. Furthermore, images with good and stable developability can be obtained while a developing device is used in an extended period of time. When a two-component developer containing the toner is used and replenished during repetitive use for a long extended period of time, the variance of the toner particle diameters is small. Good and stable developability can be obtained even with the two-component developer stirred in a developing device for an extended period of time.

There is no specific limit to the selection of the carrier. Any carrier can be suitably selected. A carrier having a core material and a resin layer covering the core material is preferably selected.

There is no specific limit to the material for the core materials. Any known materials can be suitably selected. For example, manganese-strontium (Mn—Sr) based materials and manganese-magnesium (Mn—Mg) based materials having 50 to 90 emu/g are preferred. To secure image density, highly magnetized materials such as iron powder (not less than 100 emu/g) and magnetite (ranging from 75 to 120 emu/g) are preferred. Weak magnetization materials such as copper-zinc (Cu—Zn) based materials (having 30 to 80 emu/g) are preferred since the contact of the filament to an image bearing member can be softened, which is advantageous in image quality. These can be used alone or in combination.

The particle size of the core material preferably ranges from 10 to 200 μm, and more preferably ranges from 40 to 100 μm on average (volume average particle diameter ($D_{50}$)).

There is no specific limit to the selection of materials for the resin layer and any known resin can be suitably selected to purpose. Specific examples thereof include amino-based resins, polyvinyl-based resins, polystyrene-based resins, halogenated olefin resins, polyester based resins, polycarbonate based resins, polyethylene resins, polyvinyl fluoride resins, polyvinylidene fluoride resins, polytrifluoro ethylene resins, polyhexafluoro propylene resins, copolymers of vinylidene fluoride and an acryl monomer, copolymers of vinylidene fluoride and vinyl fluoride, fluoroterpolymers such as a terpolymer of tetrafluoroethylene, vinyldene fluoride and a non-fluorine containing monomer and silicone resins. These can be used alone or in combination.

The resin layer can optionally contain electroconductive powder if desired. Specific examples thereof include metal powder, carbon black, titanium oxide, tin oxide and zinc oxide. The average particle diameter of the contained electroconductive powder is preferably not greater than 1 μm. An average particle diameter that is too large may lead to difficulty in controlling the electric resistance.

The resin layer is formed by, for example, dissolving a silicone resin in a solvent to form a liquid application, and uniformly coating the liquid application to the surface of a core material by a known method followed by drying and baking. Known coating methods include a dip coating method, a spraying method, and a brushing method.

The solvent has no specific limit and can be suitably selected. For example, toluene, xylene, methylethylketone, methylisobutyl ketone and cellosolve butyl acetate can be used.

There is no specific limit to the baking. Internal or external heating methods can be adopted. For example, methods using a fixed type furnace, a fluid type furnace, a rotary type furnace, a burner type furnace, or a microwave can be mentioned.

The content of the carrier in the resin layer preferably ranges from 0.01 to 5.0 weight %.

When the content is too small, the resin layer formed on the surface of the core material may not be uniform. When the content is too large, the resin layer formed may be so thick that carrier particles are agglomerated, which leads to difficulty in forming uniform carrier particles.

When the developer is a two-component developer, there is no specific limit to the content of the carrier contained in the two-component developer based thereon. Any content can be suitably selected to purpose. For example, the content thereof is preferably from 90 to 98 weight % and more preferably from 93 to 97 weight %.

The mixing ratio of the toner to the carrier contained in a two-component developer is typically from 1 to 10 parts by weight based on 100 parts by weight of the carrier.

The visualized images can be formed by, for example, developing latent electrostatic images with a toner or a developer using a developing device.

There is no specific limit to the developing device and any known developing device can be suitably selected as long as the developing device can perform developing with a toner or a developer. For example, a developing device which includes at least a developing unit accommodating a toner or a developer and supplying the toner or the developer to a latent electrostatic image in a contacting or non-contacting manner is preferably used.

The developing unit can be a dry type or a wet type developing system. A mono-color or multi-color developing unit can be used. For example, a developing unit having a stirring device to abrasively stir a toner or a developer to charge the toner or the developer and a rotatable magnet roller can be preferably used.

In the developing unit, for example, a toner and a developer are mixed and stirred. The toner is charged by the stirring and held on the surface of a magnet roller in rotation while forming filaments to form a magnet brush. Since the magnet roller is disposed close to an image bearing member, part of the toner forming the magnet brush formed on the surface of the magnet roller is electrically attracted and moved to the surface of the image bearing member. As a result, a latent electrostatic image is developed and visualized with the toner on the surface of the image bearing member.

A developer accommodated in the developing unit includes a toner and can be a single-component developer and a two-component developer.

Transfer Process and Transfer Device

The transfer device is a process of transferring a visualized image to a recording medium. It is preferred that the visualized image is primarily transferred to the image bearing member using an intermediate transfer body and then secondarily transferred to a recording medium. It is more preferred to use at least two color toners, preferably a full color toner in a primary transfer process in which visualized images are transferred to an intermediate transfer body to form a complex transfer (overlapped) image and in a secondary transfer process in which the complex transfer image is transferred to a recording medium.

A visualized image can be transferred by, for example, charging an image bearing member with a transfer charging device. As the transfer device, it is preferred to include a primary transfer device by which a visualized image is transferred to an intermediate transfer body to form a complex transfer (overlapped) image and a secondary transfer device by which the complex transfer image is transferred to a recording medium.

There is no specific limit to the intermediate transfer body and any known transfer body can be suitably selected to purpose. For example, a transfer belt can be suitably used.

The transfer device (the primary transfer device and the secondary transfer device) mentioned above preferably includes a transfer unit to charge and separate a visualized image formed on an image bearing member to the side of a recording medium. At least one transfer device can be provided.

As the transfer device, a corona transfer device using corona discharging, a transfer belt, a transfer roller, a pressure transfer roller and adhesive transfer device can be used.

There is no specific limit to the recording medium and any known recording medium such as recording paper can be suitably selected.

The fixing process is a process of fixing a visualized image transferred to a recording medium with a fixing device. Visualized toner images can be fixed per each color toner visualized image or overlapped visualized image.

There is no specific limit to the fixing device mentioned above and any fixing device can be suitably selected to purpose. Known fixing devices applying heat and pressure are preferred. Such a fixing device, for example, is a combination of a heating roller and a pressure roller, or a heating roller, a pressure roller and an endless belt can be mentioned.

Heating temperature of the fixing device preferably ranges from 80 to 200° C.

In the present invention, it is possible to use a known optical fixing device together with or in place of the fixing device mentioned above.

The discharging process is a process of applying a discharging bias to an image bearing member with a discharging device.

There is no specific limit to the discharging device and any known discharging device can be selected as long as the discharging device can discharge an image bearing member. For example, a discharging lamp can be suitably used.

The cleaning process is a process of removing a toner remaining on the surface of an image bearing member with a suitable cleaning device and described in detail later.

There is no specific limit to the cleaning device, so long as the cleaning device can remove toner remaining on an image bearing member. In the image forming apparatus in an embodiment of the present invention, at least a cleaning blade is used.

Figure 5:
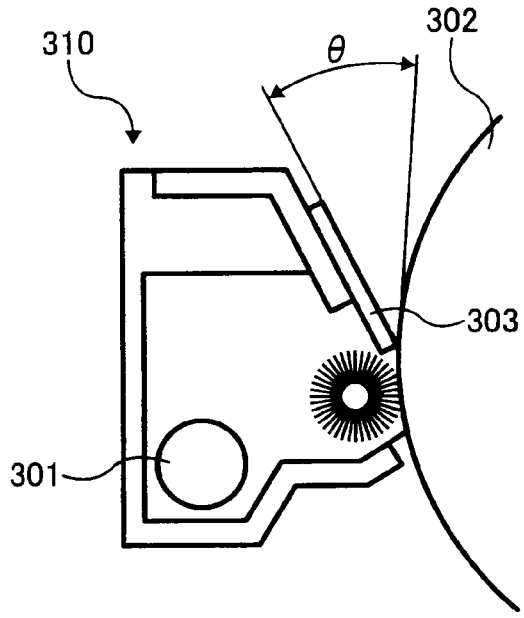
FIG. 5 is a schematic diagram illustrating an example of the counter contacting type blade cleaning system for use in a non-limiting embodiment of the image forming apparatus of the present invention.

FIG. 5 is a schematic diagram illustrating an example of the counter contacting blade cleaning system. There are two cleaning systems using a cleaning blade, a counter contacting type and a trailing contacting type. The counter contacting type system is mainly used now and the trailing contacting type system is rarely used. Therefore, the description of the blade cleaning system is limited to the case of the counter contacting type.

The blade cleaning system using a cleaning blade illustrated in FIG. 5 includes a cleaning unit 310 including a cleaning blade 303 and a toner collecting screw 301. The toner scraped from the image bearing member 302 is discharged outside the unit by the toner collecting screw 301. The edge of a cleaning blade 303 on the downstream side relative to the rotation direction of the image bearing member 302 is brought into contact with the image bearing member 302 with an angle that ranges from 3 to 40° and preferably from 5 to 25°.

Polyurethane rubber, for use in the cleaning blade 303, is formed by, for example, mixing polyester polyol and MDI (4,4'-diphenylmethane diisocyanate) serving as pre-polymers, and 1,4-butandiol and trimethylpropane serving as curing agents in a suitable ratio to obtain a liquid material, placing the material in a mold, heating the mold to 130 to 150° C. and using a method such as a centrifugal molding method and a cast press molding method.

The cleaning blade has the following characteristics (a) to (e).

(a) The thickness of the cleaning blade preferably ranges from 1 to 5 mm, and more preferably ranges from 1.5 to 3 mm.
A blade having an excessive thickness causes toner particles to clog between an image bearing member and the blade, which leads to poor cleaning performance. Therefore, a thin blade is preferred if possible.

(b) The hardness of the blade preferably ranges from 40 to 90 degrees, and more preferably ranges from 55 to 80 degrees on the hardness (JIS-A hardness K6301).
When the hardness of a blade is low on the JIS-A hardness, the front point of the blade is crushed and the contact area becomes wide so that the friction resistance increases and the blade edge is distorted due to the crush. Therefore, a gap is created between the image bearing member and the blade. Consequently, toner particles slip through the gap and the cleaning performance deteriorates. When the hardness of a blade is too high, the strength of the blade edge increases so that the adherence between the image bearing member and the blade edge is sufficiently high. However, the edge is brittle and is easily broken. In that case, the image bearing member may be scratched or the blade is not sufficiently flexible to narrow the gap formed therebetween. Therefore, toner particles may slip through the blade, which causes deterioration of cleaning performance.

(c) The surface roughness of the blade edge is preferably not greater than 10 μm, and more preferably not greater than 5 μm.
The surface roughness of the blade edge has a significant impact on the cleanability of a toner. That is, when the surface roughness is too large, toner particles freely slip through the blade and the blade is useless. When a contact pressure (e.g., not less than 20 g/cm) is applied to a blade having a suitable surface roughness (i.e., not greater than 10 μm), the blade is bowed and can be sufficiently adhered to the image bearing member. However, when the contact pressure is lessened, for example, not greater than 20 g/cm, the surface roughness of a blade is preferably slightly reduced and preferably ranges from 5 to 6 μm. When a blade edge does not sufficiently block toner and carrier particles so that a slight amount thereof keeps slipping through a blade, the blade may be broken. Therefore, it is desired to prevent deterioration of cleaning performance.

(d) The Young's modulus (elastic constant) of a blade preferably ranges from 4 to 10 $N/mm^2$ and more preferably about 6 $N/mm^2$.

(e) 100% modulus of a blade preferably ranges from 2 to 5 Mpa.

(f) 300% modulus of a blade preferably ranges from 10 to 15 Mpa.

(g) Rebound resilience (JIS K6301) preferably ranges from 10 to 80. That is, when a cleaning blade is pressed against an image bearing member under a pressure (contact pressure), it is desired that a gap between the blade and the image bearing member is not formed, and that the blade has a suitable flexibility and physical characteristics for adhesiveness.

Next, the method of manufacturing a cleaning blade 33 is described with reference to FIGS. 6 and 7.

The cleaning blade 33 is fixed onto a substrate 30 having a high rigidity with an adhesive agent having a great attachment force, such as a hot melt adhesive agent.

As a substrate, metals such as aluminum, brass, iron and stainless steel are used. It is preferred to use a metal having a high rigidity and a high vibration suppressing property. A blade not having a sufficient vibration suppressing property is subject to vibration suppression treatment. The vibration suppression treatment is to restrain squeak of a blade occurring when the blade abrades an image bearing member. Butyl rubber and Sorbothane (a synthesized rubber like butyl rubber) are used as the vibration suppression material.

The thickness of the metal of the substrate 30 mentioned above ranges from about 1 to 5 mm and preferably ranges from about 1.5 to 3 mm.

The thickness of the substrate 30 made of stainless steel is preferably not less than 1.5 mm. The thickness of the substrate 30 made of brass or iron is preferably not less than 2 mm. The thickness of the substrate 30 made of aluminum is preferably about 3 mm. When the substrate 30 having an insufficient rigidity is used, the cleaning blade 33 thereof vibrates when an image bearing member rotates so that the cleaning performance tends to deteriorate. Therefore, it is desired to fix the cleaning blade 33 sufficiently to prevent microvibration thereof.

Figure 6:
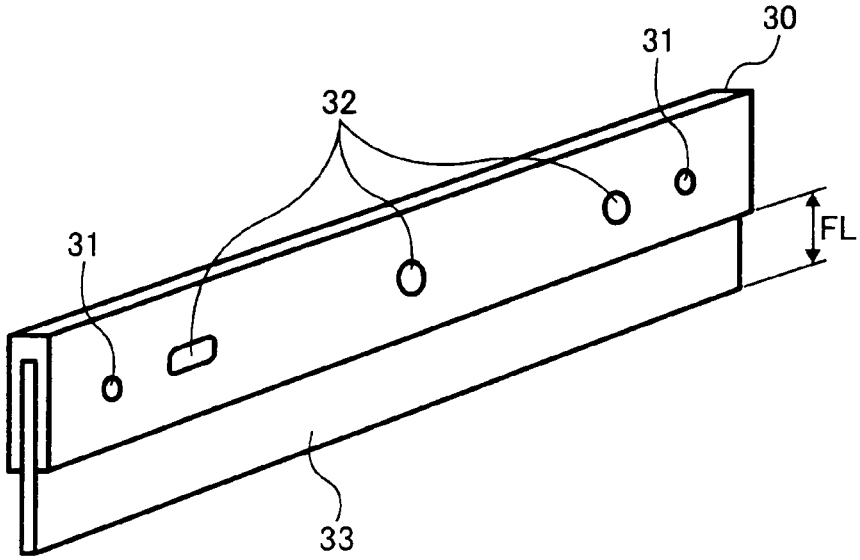
FIG. 6 is a schematic diagram illustrating a non-limiting example of the cleaning blade three-side shaped substrate.
Figure 7:
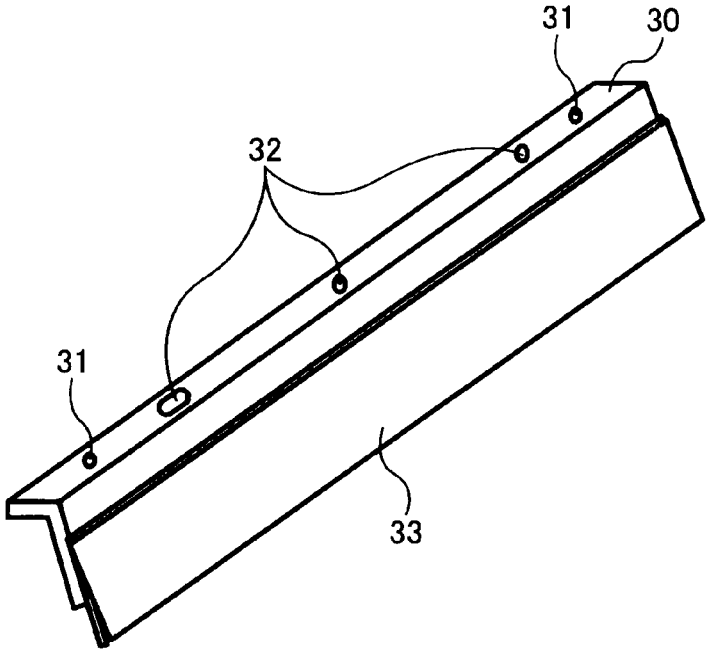
FIG. 7 is a schematic diagram illustrating a non-limiting example of the cleaning blade L shaped substrate.

As illustrated in FIGS. 6 (three-side shaped substrate) and 7 (L-shaped substrate), positioning holes 31 and screw retaining holes 32 are made in the substrate 30. In the case of an image forming apparatus, a process cartridge or a cleaning unit is fixed with screws while the case, the process cartridge and the cleaning unit are under pressure (contact pressure). There are two methods of fixing an object to which the cleaning blade 33 is fixed. One is a constant displacement method of completely fixing the cleaning blade 33 and the other is a constant load method of suspending the cleaning blade 33 with a spring.

In the case of the constant displacement method, when the blade edge gets abraded, the contact pressure is gradually relaxed, which may gradually degrade the cleaning performance. However, the cleaning blade 33 does not vibrate so that the cleaning performance is generally better than that in the case of the spring suspension method. The fixed method is considered to be suitable when removing a toner having a sphere form.

In the case of the constant load method (the spring suspension method), the cleaning performance is stable even when the blade edge gets abraded since a significantly constant load is applied to an image bearing member. However, when the spring is not strong, the cleaning blade 33 may move in the right and left direction due to the rotation of the image bearing member. Therefore, the chance of a toner particle slipping through the cleaning blade 33 increases and the cleaning performance is slightly inferior to that of the constant displacement method.

When the cleaning blade 30 is adhesively fixed to the substrate 30 with an adhesive agent, a free length FL thereof, preferably ranges from 1 to 10 mm, and more preferably ranges from 2 to 8 mm. It is desired to have this range of the free length FL to keep the blade edge attached to an image bearing member without a gap over an extended period of time. Meaning, the cleaning blade 33 is desired to have a suitable flexibility. An inflexible cleaning blade tends to form a gap between the cleaning blade and an image bearing member, which leads to deterioration of the cleaning performance. Therefore, it is preferred to secure the free length FL to some degree for the cleaning blade 33. However, when the free length FL of the cleaning blade 33 is excessively long, the cleaning blade 33 may be distorted and vibrate. Therefore, although it depends on the thickness and the hardness of the cleaning blade 33, it is preferred to restrain the free length FL of the cleaning blade 33 to a value not greater than 10 mm, and more preferably in a range of 2 to 8 mm.

The free length FL (the width=length of the portion which is not fixed to a substrate) of a blade is preferably in the range of 1 to 10 mm, and more preferably in the range of 2 to 8 mm.

The cleaning blade 33 is fixed onto the substrate 30 and is fixed against an image bearing member with a contact angle of the following range.

The angle (contact angle) of the cleaning blade 33 contacting an image bearing member preferably ranges from 3 to 40°, and more preferably ranges from 5 to 25°. An excessively large or small contact angle has an adverse impact on the cleaning performance. Therefore, it is preferred to set the contact angle within a suitable range.

When the contact angle is too small, the blade edge floats and does not contact an image bearing member in an adhesive manner, thereby, resulting in deterioration of cleaning performance. To the contrary, when the contact angle is too large, toner particles clog between an image bearing member and the portion of the cleaning blade 33 counter-contacting therewith. The clogged toner particles press up the blade edge and causes deterioration of cleaning performance. As the width of the cleaning blade 33 increases, toner particles tend to clog and cause filming, abrasion and scratching of the image bearing member. Therefore, the cleaning blade 33 is desired to be narrow in width.

It is possible to apply an electroconductive coating medium to the lateral side of the cleaning blade 33 and apply a voltage thereto. A voltage is applied to the cleaning blade 33 to prevent toner from attaching thereto so that it is possible to restrain the deterioration of cleaning performance caused by attachment of toner to the cleaning blade 33. This application of voltage is effective to toner near the electroconductive coating material. However, the electric field hardly affects the other toner. Therefore, this is not very effective when a large amount of toner flows to the cleaning portion.

Next, a cleaning system using both a fur brush and a cleaning blade is described.

In the cleaning method using a cleaning unit including a fur brush and a cleaning blade, typically, a fur brush is disposed on the upstream side (closer to the transfer device) and a cleaning blade is disposed on the down stream side (closer to the charging device side) relative to the rotation direction of the image bearing member. The cleaning method using a cleaning unit including a fur brush and a cleaning blade is advantageous for a high volume image forming apparatus.

This is because it is impossible to deal with a large amount of powder remaining after transfer with a cleaning blade only. Therefore, it is preferred to provide a device supplementary to a cleaning blade.

When remaining powder flows into or accumulates at the cleaning portion of a cleaning blade in a large amount, the cleaning blade is under a heavy load, which has an adverse impact on the durability thereof and cleaning performance. This leads to contamination of a charging device and degradation of image quality such as SN ratio.

A fur brush is provided to relieve the burden on a cleaning blade by preliminarily removing the toner flowing to the cleaning portion of the cleaning blade and maintain the cleaning performance by the cleaning blade.

When the cleaning condition is set in such a manner that the ratio (Ton−T0)/(Toff−T0) is in the range of 1.2 to 3.8, the cleaning performance is good. When the ratio is too small, toner may slip through, resulting in deterioration of the cleaning performance. Such an excessively small ratio does not have a large margin for the change in the rubber characteristics of a blade, which may accelerate the deterioration of the cleaning performance in a low temperature environment. To the contrary, when the ratio (Ton−T0)/(Toff−T0) is too great, toner easily gets abraded with an image bearing member during removal of toner, which may lead to an increase in the amount of scraping of image bearing member and the occurrence of filming.

JOP 2002-31994 describes a technology in which a good cleanability is obtained by measuring the rotation torques ($T_{off}$ and $T_{on}$) of an image bearing member when a toner is not supplied and when a toner is supplied, and restraining the difference between and the ratio of $T_{off}$ and $T_{on}$ in a range. That is, in this technology, the cleaning condition is set such that torque $T_{on}$ of when toner is removed is greater than torque $T_{off}$. The methods of regulating the conditions are different in embodiments of the present invention and JOP 2002-31994.

Embodiments of the present invention are different from JOP 2002-31994 in that an image bearing member which is easily scraped and has a relatively good cleanability with a large range of cleaning conditions and a low friction coefficient with an extremely small blade contacting pressure of from 1.5 to 10 g/cm can be used to improve the durability of the image bearing member and the blade.

The blade contacting pressure and $(T_{off}-T_0)/r$ have a linear correlation and the inclination of the correlation is considered to vary depending on the dynamic friction coefficient of an image bearing member.

The blade contacting pressure preferably ranges from 1.5 to 10 g/cm, and more preferably ranges from 2 to 8 g/cm. When the blade contacting pressure is too large, the abrasion amount of the image bearing member tends to be large. When the blade contacting pressure is too small, the effect of holding a toner tends to weaken, which may reduce the margin of good cleaning performance.

$(T_{off}-T_0)/r$ preferably ranges from 0.01 to 0.15 kg, and more preferably ranges from 0.02 to 0.14 kg. When $(T_{off}-T_0)/r$ is too small, the effect of holding a toner tends to decrease, which may reduce the margin of cleaning performance. When $(T_{off}-T_0)/r$ is too large, the abrasion amount of the image bearing member tends to be large.

The total runout relative to the rotation axis of an image bearing member is preferably not greater than 0.080 mm. When the total runout increases while the blade contacting pressure is small, the cleaning performance may deteriorate due to the rotation cycle of the image bearing member.

Further, the straightness of a cleaning blade is preferably not greater than 0.1 mm. When the straightness it too great and the blade contacting pressure is small, the contacting pressure to the image bearing member at the blade nip may become uneven, which leads to production of abnormal images having a streak or a strip due to deterioration of the cleaning performance.

The straightness of a cleaning blade is measured as follows: Tilt the cleaning blade to be measured at 45 degrees; measure the distance between the edge of the cleaning blade and a knife edge disposed in parallel with both ends of the imaging area of the edge of the cleaning blade which contacts the image bearing member over the imaging area with a laser beam.

The recycling process is a process of recycling a color toner for use in electrophotography removed by the cleaning process mentioned above for reuse in a developing device and can be suitably performed with a recycling device.

There is no specific limit to the recycling device and any known transfer device can be used.

The controlling process is a process of controlling each of the processes mentioned above and can be suitably performed with a controlling device.

There is no specific limit to the controlling device as long as the controlling device can control the behaviors of each of the devices mentioned above. Any controlling device can be suitably selected. For example, devices such as a sequencer and a computer can be used.

As a recording medium, plain paper is a representative medium. There is no specific limit to the recording medium as long as an unfixed developed image can be transferred thereto. Any recoding medium can be suitably selected. Polyethylene terephthalate base film (celluloid) for an overhead projector can be used.

Figure 8:
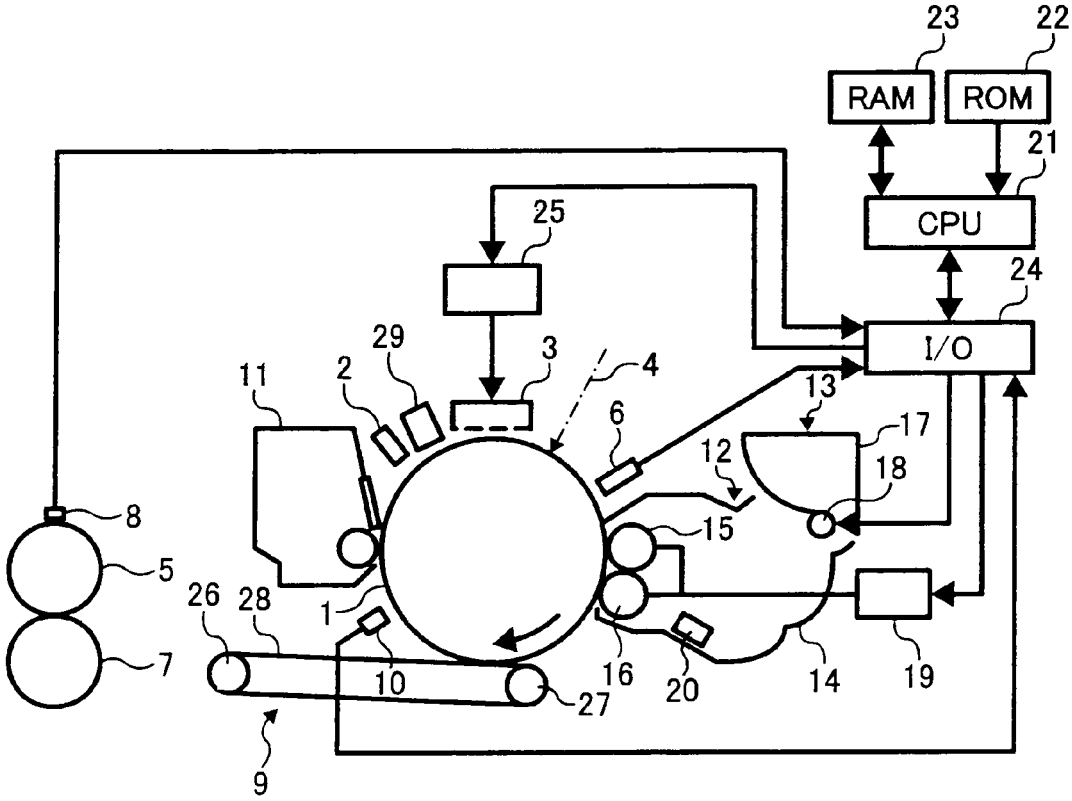
FIG. 8 is a schematic diagram illustrating a non-limiting example of the image forming apparatus, such as a digital photocopier, of the present invention.

FIG. 8 is a diagram illustrating an example of the image forming apparatus (e.g., a digital photocopier) of the present invention. In the image forming apparatus illustrated in FIG. 8, 1 represents an image bearing member (drum); 2 represent a discharging lamp; 3 represents a charging device; 4 represents a laser beam (writing light) generated by a laser diode (LD); 5 represents a fixing roller; 6 represents a voltage sensor; 7 represents a pressing roller; 8 represents a temperature sensor; 9 represents a transfer unit; 10 represents an optical reflection type photosensor; 11 represents a cleaning unit; 12 represents a developer stirring portion; 13 represents a toner replenishing portion; 14 represents a developing unit; 15 represents a first developing roller; 16 represents a second developing roller; 17 represents a toner hopper; 18 represents a toner replenishing roller; 19 represents a developing bias power source; 20 represents a toner density sensor; 21 represents a central processing unit (CPU); 22 represents a read only memory (ROM); 23 represents a random access memory (RAM); 24 represents an I/O; 25 represents a power supply for the charging device; 26 represents a transfer belt driving roller; 27 represents a transfer belt driven roller; 28 represents a transfer belt; and 29 represents a temperature sensor.

Image forming operation by the image forming apparatus is common and typical and is briefly described next with reference to FIG. 8.

A document on a contact glass is irradiated by an irradiating lamp. The reflected light is read by a scanner (not shown). The laser diode (LD), triggered according to the image read by the scanner irradiates the image bearing member 1 uniformly charged by the charging device 3 with the laser beam 4. A latent electrostatic image is obtained on the image bearing member 4 and is visualized with a toner by the developing unit 14. The toner image formed on the image bearing member 1 is transferred to a transfer medium by the transfer unit 9. Finally, the transfer medium is discharged via a fixing unit including the fixing roller 5 and the pressing roller 7.

A tandem type color image forming apparatus is described in detail with reference to FIG. 9. The tandem type color image forming apparatus includes a main body 250, a medium feeding table 200, a scanner 300 and an automatic document feeder (ADF) 400. FIG. 10 is an enlarged schematic diagram illustrating part of the image forming apparatus illustrated in FIG. 9.

The main body 250 includes an intermediate transfer body 150 having an endless belt form disposed in the center portion thereof. The intermediate transfer body 150 is suspended over supporting rollers 114, 115 and 116 and set to be rotatable clockwise in FIG. 9. A cleaning device 117 for the intermediate transfer body 150 to remove remaining toner thereon is disposed in the vicinity of the supporting roller 115. A tandem type developing unit 120 including four image forming units 118 for yellow, cyan, magenta and black in a tandem manner along the conveying direction of the intermediate transfer body 150 is disposed opposing the portion of the intermediate transfer body 150 suspended between the supporting rollers 114 and 115. There is provided an irradiating device 121 in the vicinity of the tandem type developing unit 120. A secondary transfer device 122 is disposed on the opposite side to the side on which the tandem type developing unit 120 is disposed relative to the intermediate transfer body 150. In the secondary transfer belt 122, a secondary transfer belt 124 having an endless form is suspended over a pair of rollers 123. A transfer medium conveyed on the secondary transfer belt 124 and the intermediate transfer body 150 can contact each other. A fixing device 125 is disposed in the vicinity of the secondary transfer device 122. The fixing device 125 includes a fixing belt 126 having an endless form and a pressing roller 127 pressed by the fixing belt 126.

As to the tandem image forming apparatus, in the vicinity of the secondary transfer device 122 and the fixing device 125, a medium reversing device 128 is disposed to reverse a transfer medium to form images on the double sides thereof. Reference numerals 155, 156 and 157 represent a pair of transfer rollers, a pair of discharging rollers and a discharging tray, respectively.

Next, full color image formation using the tandem type image forming apparatus is described. There are two ways of setting a document. One is to set a document on a document setting table 130 of the automatic document handler (ADF) 400. The other is to open the automatic document handler 400, set a document on the contact glass 132 of the scanner 300 and close the automatic document handler 400.

When a starting switch (not shown) is pressed, the document set on the automatic document handler 400 is transferred to the contact glass 132 and then the scanner 300 drives a first scanning body 133 and a second scanning body 134. In the case of the document set on the contact glass 132 from the beginning, the scanner 300 immediately starts the operation. When the light source irradiates the document, the first scanning body 133 reflects the light from the document and the mirror included in the second scanning body 134 reflects the reflected light from the first scanning body 133. The reflected light is received at a reading sensor 136 via an image forming lens 135 to read the document and obtain image information of black, yellow, magenta and cyan.

Each piece of image information for black, yellow, magenta and cyan is conveyed to respective image forming devices 118 (image forming device for black, image forming device for yellow, image forming device for magenta and image forming device for cyan) in the tandem type image forming apparatus. At each image forming device, each color toner image of black, yellow, magenta and cyan is formed.

As illustrated in FIG. 10, each image forming device 118 (image forming device for black, image forming device for yellow, image forming device for magenta and image forming device for cyan) included in the tandem type image forming apparatus includes an image bearing member 110 (an image bearing member 110K for black, an image bearing member 110Y for yellow, an image bearing member 110M for magenta and an image bearing member 110C for cyan), a charging device 160, an irradiating device (not shown), a developing unit 161, a transfer charging device 162, a cleaning device 163 for the image bearing member 110, and a discharging device 164. The charging device 160 uniformly charges the image bearing member 110. The irradiating device irradiates the image bearing member 110 imagewise with light L based on each color image information and forms a latent electrostatic image corresponding to each color image on the image bearing member 110. The developing unit 161 develops the latent electrostatic image with each color toner (black toner, yellow toner, magenta toner and cyan toner) to form each color toner image on the image bearing member 110. The transfer charging device 162 transfers the toner image to the intermediate transfer body 150. Thereby, based on each color image information, each single color image (black image, yellow image, magenta image and cyan image) can be formed.

The thus formed black image formed on the image bearing member 110K, the thus formed yellow image formed on the image bearing member 110Y, the thus formed magenta image formed on the image bearing member 110M and the thus formed cyan image formed on the image bearing member 110C are primarily transferred to the intermediate transfer body 150 rotationally moved by the supporting rollers 114, 115 and 116. The black image, the yellow image, the magenta image and the cyan image are overlapped on the intermediate transfer body 150 to form a synthesized color image (color transferred image).

At the medium feeding table 200, one of feeding rollers 142 is selectively rotated and a recording medium is fed from one of medium feeding cassettes 144, multi-stacked in a medium bank 143. A separation roller 145 separates media one by one and sends out the separated medium to a medium path 146. A transfer roller 147 transfers and guides the medium to a paper path 148 in the main body 250. The medium is stopped at a registration roller 149. Or a recording medium placed on a manual feeding tray 151 can be fed by rotating the feeding roller 142, separated one by one by the separation rollers 152, fed into a manual medium feeding path 153 and stopped at the registration roller 149. The registration roller 149 is typically grounded for use, but can be also used in the state in which a bias is applied to remove dust of a recording medium.

The registration roller 149 is rotated to the timing of the synthesized color image (transferred color image) on the intermediate transfer body 150 to transfer a recording medium between the intermediate transfer body 150 and the secondary transfer device 122. The synthesized color image is transferred to the recording medium by secondary transferring by the secondary transfer device 122. Toner remaining on the intermediate transfer body 150 after the image transfer is removed by a cleaning device 117 for the intermediate transfer body 150.

As illustrated in FIG. 10, among the components forming the image forming device 118, the charging device 160 has a roller form and contacts and charges the image bearing member 110 by applying a bias thereto. It is also possible to charge the image bearing member 110 by a non-contact type charging device such as a scorotron charger.

The developing device 161 uses a two-component developer containing a magnetic carrier and a non-magnetic toner in the example illustrated in FIG. 10, but can use a single-component developer. The developing device 161 includes a stirring portion 166 to supply the two-component developer to a developing sleeve 165 while stirring and a developing portion 167 to transfer the toner contained in the two-component developer attached to the developing sleeve 165 to the image bearing member 110. The developing portion 167 is disposed above the stirring portion 166.

The stirring portion 166 includes two screws 168 disposed in parallel. A partition plate 169 is disposed between the two screws 168 to part them except their both ends. A toner density sensor 171 is attached to a developing case 170.

The developing portion 167 includes the developing sleeve 165 opposing the image bearing member 110 through an opening of the developing sleeve 170 and a magnet 172 is fixed inside the developing sleeve 165. A doctor blade 173 is provided with its front end close to the developing sleeve 165. In the example illustrated in FIG. 10, the shortest distance between the doctor blade 173 and the developing sleeve 165 is set to be 500 μm.

The two screws 168 stirs, circulates and conveys the two-component developer to the developing sleeve 165. The developer supplied to the developing sleeve 165 is drawn up and held by the magnet 172 and forms magnet brush on the developing sleeve 165. The magnet brush is cut to a suitable height by the doctor blade 173 as the developing sleeve 165 rotates. The developer chopped off from the magnet brush is returned to the stirring portion 166.

On the other hand, the toner contained in the developer on the developing sleeve 165 is transferred to the image bearing member 110 by the developing bias applied to the developing sleeve 165 to visualize the latent electrostatic image on the image bearing member 110. The developer remaining on the developing sleeve 165 is detached off therefrom when the developer reaches the area out of the magnet force of the magnet 172 and returned to the stirring portion 166. While this operation is repeated, the toner density in the stirring portion 166 becomes thin. This is detected by the toner density sensor 171 and toner is replenished to the stirring portion 166.

In the example illustrated in FIG. 10, the developing process is performed under the condition that the linear velocity of the image bearing member 110 is 125 mm/s, the linear velocity of the developing sleeve 165 is 150 mm/s, the diameter of the image bearing member 110 is 30 mm, and the diameter of the developing sleeve 65 is 18 mm. The amount of the charge of the toner on the developing sleeve 165 suitably ranges from −10 to −30 μC/g. The developing gap $G_p$, which is the gap between the image bearing member 110 and the developing sleeve 165, can be set in the typical range of from 0.4 to 0.8 mm. It is possible to improve the developing efficiency by decreasing the value thereof.

The thickness of the image bearing member 110 is set to be 28 μm, the beam spot diameter of the optical system is set to be 50×60 μm and the amount of light is set to be 0.47 mW. During the development process, the charging (prior to irradiation) voltage $V_o$ of the image bearing member 110 is −700 V, the voltage $V_L$ after irradiation is −120 V and the developing bias is −470 V, i.e., the developing potential is 350 V.

The first transfer device 162 has a roller form and is press-contacted with the image bearing member 110 with the intermediate transfer body 150 therebetween. The first transfer device 162 can have an electroconductive brush form and a non-contact type corona charger.

A cleaning device 163 for the image bearing member 110 is disposed with its front end press-contacted with the image bearing member 110. For example, the cleaning device 163 has a cleaning blade 175 made of polyurethane rubber. To improve the cleaning performance thereof, the cleaning device 163 also has a brush with its circumference contacting the image bearing member 110. An electroconductive fur brush 176 is provided in the example illustrated in FIG. 10 with its circumference contacting the image bearing member 110 and can rotate in the direction indicated by the arrow. A metal electric field roller 177 which applies a bias to the brush 176 is provided and rotates in the direction indicated by the arrow. A scraper 178 is provided with its front end contact-pressed against the metal electric field roller 177. Further, a toner collecting screw 179 is provided to retrieve the toner removed.

The fur brush 176, which counter-rotates to the image bearing member 110, removes the toner reaming on the image bearing member 110. The toner attached to the fur brush 176 is removed by the metal electric field roller 177, which is biased, contacts and counter-rotates to the fur brush 176. The toner attached to the metal electric field roller 177 is removed by the scraper 178. The toner retrieved by the cleaning device 163 for the image bearing member 110 is moved to one side of the cleaning device 163 by the toner collecting screw 179 and returned to the developing device 161 by a toner recycling device 180 for reuse.

A discharging device 164 is, for example, a lamp, and irradiates the surface of the image bearing member 110 with light to initialize the surface voltage thereof.

When the image bearing member 110 rotates, the charging device 160 uniformly charges the surface of the image bearing member 110 and the irradiating device 121 irradiates the image bearing member 110 with the writing light L such as a laser beam generated by an LED to form a latent electrostatic image on the image bearing member 110.

Thereafter, the toner is attached by the developing device 161 to visualize the latent electrostatic image. The visualized image is transferred to the intermediate transfer body 150 by the primary transfer device 162. After the image transfer, the surface of the image bearing member 110 is cleared of the toner remaining thereon by the cleaning device 163 for the image bearing member 110 and discharged by the discharging device 164 to be ready for next image formation cycle.

Figure 9:
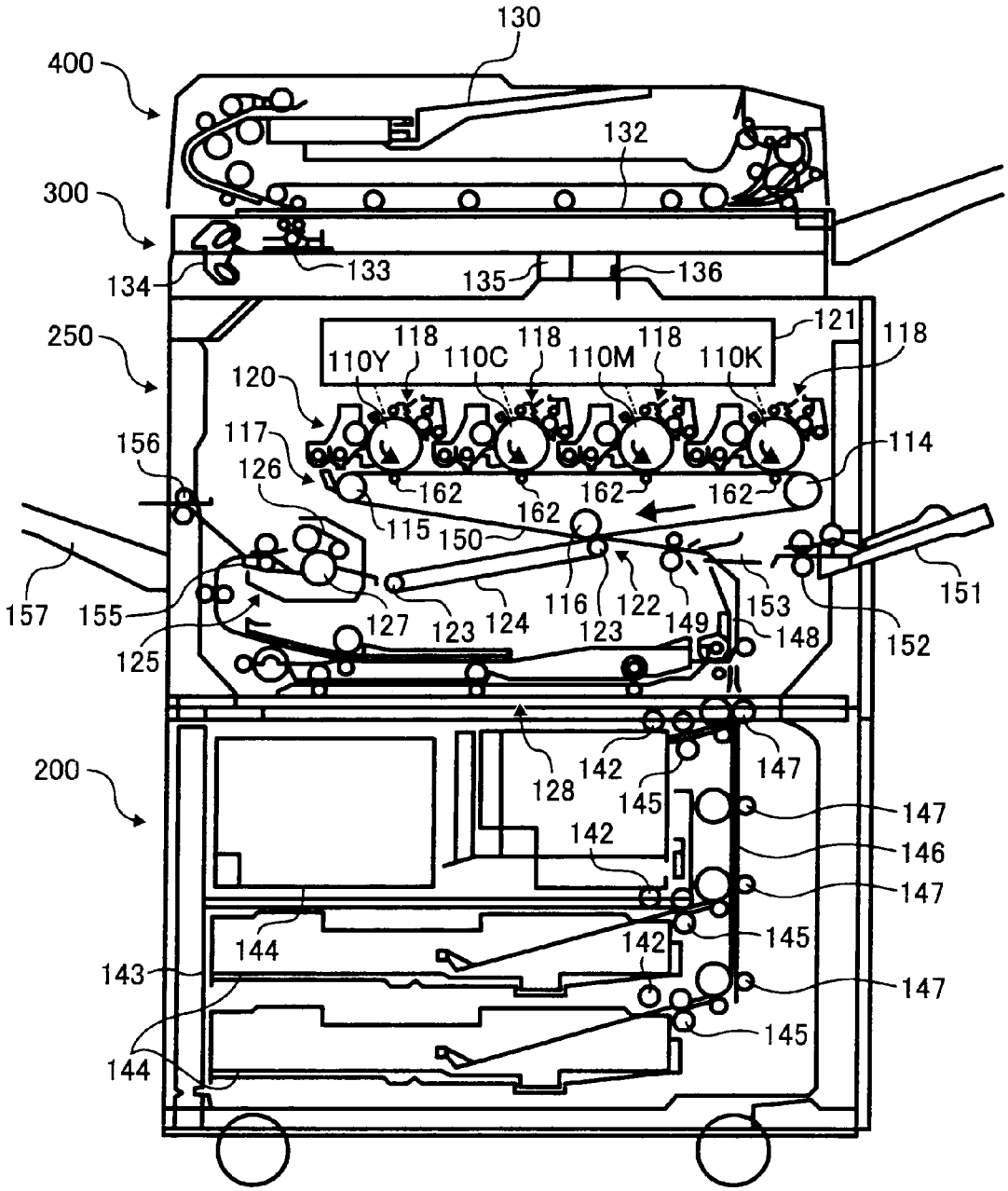
FIG. 9 is a schematic diagram illustrating a non-limiting example of the image forming apparatus (tandem type color image forming apparatus) of the present invention that performs the image forming method of the present invention.
Figure 10:
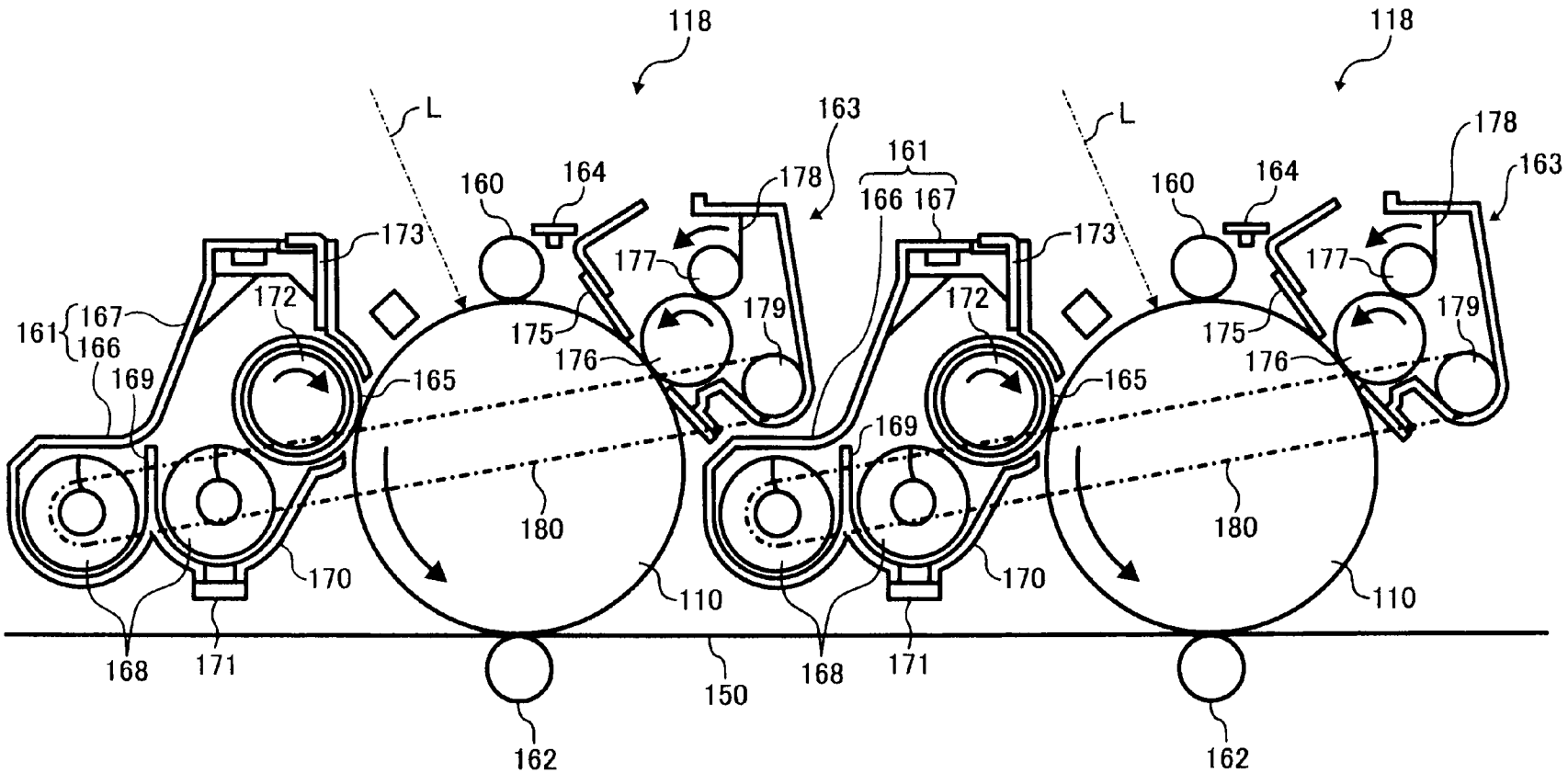
FIG. 10 is an enlarged schematic diagram illustrating a part of the image forming apparatus illustrated in FIG. 9.

The tandem type color image forming apparatus illustrated in FIGS. 9 to 10 includes four of the image bearing members manufactured as described above. The image forming apparatus of this embodiment is equal to four image forming apparatuses arranged side by side in a tandem manner except that toner images are overlapped on the intermediate transfer body and the intensity of irradiation light is controlled color by color.

Process Cartridge

An embodiment of the process cartridge of the present invention includes an image bearing member and at least one of a charging device, a developing device, a transfer device, a cleaning device and a discharging device. The cleaning device removes the toner remaining on the surface of the image bearing member by contacting a cleaning blade included in the cleaning device therewith. The process cartridge can optionally include other devices if desired.

The static friction coefficient (μ) of the image bearing member ranges from 0.1 to 0.3. The contact pressure of the cleaning blade against the image bearing member ranges from 1.5 to 10 g/cm. Further, the image bearing member and the cleaning blade satisfy the following relationships (1) and (2).

$$0.01\ (\text{kg}) \leqq (T_{off}-T_0)/r \leqq 0.15\ (\text{kg}) \qquad \text{Relationship (1)}$$

$$1.2 \leqq (T_{on}-T_0)/(T_{off}-T_0) \leqq 3.8 \qquad \text{Relationship (2)}$$

In the relationships (1) and (2), $T_0$ represents a rotation torque (kgcm) of the image bearing member when the cleaning blade is not in contact with the surface of the image bearing member, $T_{off}$ represents a rotation torque (kgcm) of the image bearing member when the cleaning blade is brought into contact with the surface of the image bearing member and an image is developed with toner, $T_{on}$ represents a rotation torque (kgcm) of the image bearing member when the cleaning blade is brought into contact with the surface of the image bearing member and an image is developed with toner, and r represents a radius of the image bearing member.

The developing device includes a developer container for accommodating a toner and a developer, a developing roller for bearing and transferring the toner and the developer accommodated in the developer container and optionally a layer thickness regulating member for regulating the layer thickness of the toner borne on the developing roller.

The process cartridge of the present invention is detachably attached to various kinds of electrophotographic apparatuses, facsimile machines and printers, and is preferably detachably attached to an embodiment of an image forming apparatus of the present invention.

Figure 11:
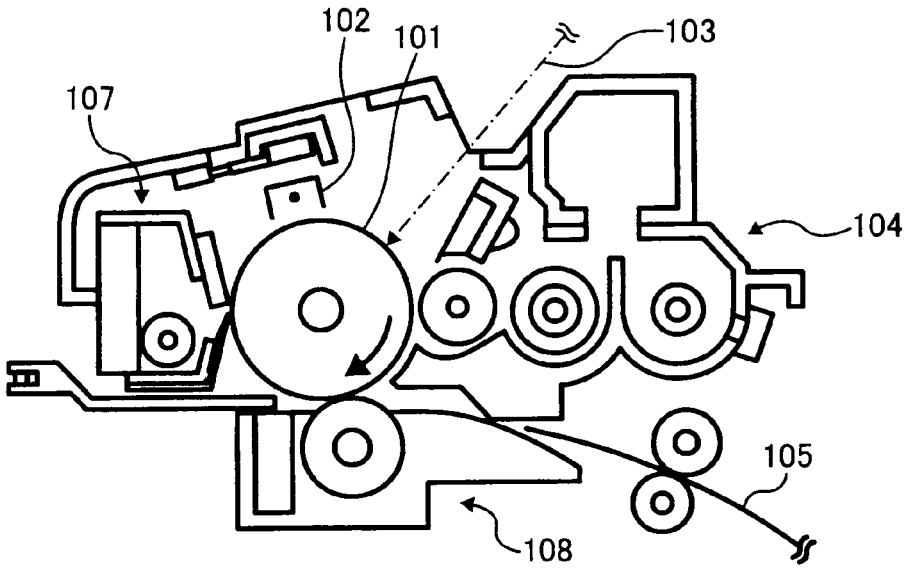
FIG. 11 is a schematic diagram illustrating a non-limiting example of the process cartridge of the present invention.

As illustrated in FIG. 11, the process cartridge mentioned above includes an image bearing member 101 and at least one of a charging device 102, a developing device 104, a transfer device 106, a cleaning device 107 and a discharging device (not shown). The process cartridge illustrated in FIG. 11 is a device that is detachably attached to the main body of an image forming apparatus.

The image forming process performed by the process cartridge illustrated in FIG. 11 is as follows. According to charging by the charging device 102 and irradiation light 103 by an irradiating device (not shown), a latent electrostatic image corresponding to an irradiation image is formed on the surface of the image bearing member 101 while the image bearing member 101 rotates in the direction indicated by the arrow. This latent electrostatic image is developed with a toner by the developing device 104. The toner image is transferred to a recording medium 105 by a transfer device 106 and printed out. After the image transfer, the surface of the image bearing member 101 is cleaned by the cleaning device 107 and discharged by a discharging device (not shown). This process is repeatedly performed.

It is possible to integrally structure the latent electrostatic image bearing member, the developing device, the cleaning device, etc., as a process cartridge. The process cartridge can be detachably attached to embodiments of the image forming apparatus of the present invention. In addition, it is also possible to integrally structure an image bearing member with at least one of a charging device, an irradiating device, a developing device, a transfer device, a separating device and a cleaning device as a process cartridge. The process cartridge can be detachably attached as a single unit to the main body of an image forming apparatus using a guiding device such as a rail attached to the main body.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Example 1

Manufacturing of Image Bearing Member 1

The following liquid application for an undercoating layer, for a charge generating layer and for a charge transport layer are applied to an aluminum cylinder having a diameter of 30 mm in this order by a dip coating method. Subsequent to drying, Image bearing member 1 is obtained, which has an undercoating layer having a thickness of 3.5 μm, a charge generating layer having a thickness of 0.2 μm and a charge transport layer having a thickness of 27 μm.

Liquid Application for Undercoating Layer

| | |
|---|---|
| Titanium dioxide powder | 400 parts |
| Melamine resin | 65 parts |
| Alkyd resin | 120 parts |
| 2-butanone | 400 parts |

Liquid Application for Charge Generating Layer

| | |
|---|---|
| Bisazo pigment represented by the following chemical structure<br>Chemical structure 1 | 12 parts |

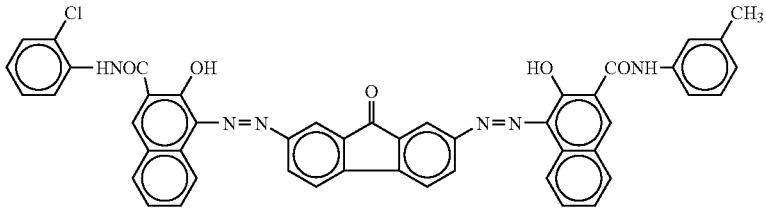

| | |
|---|---|
| Polyvinylbutyral | 5 parts |
| 2-butanone | 200 parts |
| cyclohexanone | 400 parts |

Liquid Application for Charge Transport Layer

| | |
|---|---|
| Polycarbonate (Z Polica, manufactured by Teijin Chemicals Ltd. ) | 8 parts |
| Charge Transport Layer Represented by the Following Chemical Structure<br>Chemical structure 2 | 10 parts |

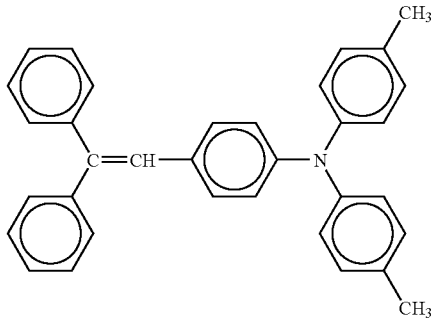

| | |
|---|---|
| Tetrahydrofuran | 100 parts |

Manufacturing Example 2

Manufacturing of Image Bearing Member 2

The liquid application prepared as described in Manufacturing Example 1, for an undercoating layer, for a charge generating layer and for a charge transport layer are applied to an aluminum cylinder having a diameter of 30 mm in this order by a dip coating method. Subsequent to drying, an undercoating layer having a thickness of 3.5 μm, a charge generating layer having a thickness of 0.2 μm and a charge transport layer having a thickness of 27 μm are obtained.

The following liquid application for a protective layer is applied to the charge transport layer by a spraying method (spraying gun: PieceCom PC308 with an air pressure of 2 kgf/cm$^2$, manufactured by Olympos Co., Ltd.). Subsequent to drying at 150° C. for 60 minutes, Image bearing member 2 having a protective layer having a thickness of 5 μm is obtained.

Preparation of Liquid Application for Protective Layer

The solution having the following components are placed in a high speed liquid collision device (Ultimaizer HJP-25005, manufactured by Sugino Machine Limited) and circulated for 30 minutes under a pressure of 100 MPa. The liquid application for a protective layer is obtained after irradiation of supersonic wave for 10 minutes.

Solution

| | |
|---|---|
| PFA resin particles (MPE-056, manufactured by Du pont Mitsui Fluorochemical Co., Ltd. | 1.0 parts |
| Dispersion helper (Modiper F210, manufactured by NOF Corporation) | 0.1 parts |
| Polycarbonate (Z Polica, manufactured by Teijin Chemicals Ltd.) | 8.9 parts |
| Tetrahydrofuran | 200 parts |
| Cyclohexanone | 60 parts |

Manufacturing Example 3

Manufacturing of Image Bearing Member 3

Image bearing member 3 is manufactured in the same manner as in Manufacturing Example 1 except that a protective layer is formed using the following liquid application for a protective layer.

Liquid of Application for Protective Layer

| | |
|---|---|
| PFA resin particles (MPE-056, manufactured by Du pont Mitsui Fluorochemical Co., Ltd. | 3.5 parts |
| Dispersion helper (Modiper F210, manufactured by NOF Corporation) | 0.35 parts |
| Polycarbonate (Z Polica, manufactured by Teijin Chemicals Ltd.) | 6.15 parts |
| Tetrahydrofuran | 200 parts |
| Cyclohexanone | 60 parts |

Manufacturing Example 4

Manufacturing of Image Bearing Member 4

Image bearing member 4 is manufactured in the same manner as in Manufacturing Example 1 except that a protective layer is manufactured using the following liquid of application for a protective layer.

Preparation of Liquid Application for Protective Layer

| | |
|---|---|
| PFA resin particles (MPE-056, manufactured by Du pont Mitsui Fluorochemical Co., Ltd. | 5.5 parts |
| Dispersion helper (Modiper F210, manufactured by NOF Corporation) | 0.55 parts |
| Polycarbonate (Z Polica, manufactured by Teijin Chemicals Ltd.) | 3.95 parts |
| Tetrahydrofuran | 200 parts |
| Cyclohexanone | 60 parts |

Manufacturing Example 5

Manufacturing of Image Bearing Member 5

Image bearing member 5 is manufactured in the same manner as in Manufacturing Example 1, except that a protective layer is manufactured using the following liquid application for a protective layer.

Preparation of Liquid of Application for Protective Layer

| | |
|---|---|
| PFA resin particles (MPE-056, manufactured by Du pont Mitsui fluorochemical Co., Ltd. | 70 parts |
| Dispersion helper (Modiper F210, manufactured by NOF Corporation) | 0.7 parts |

-continued

| | |
|---|---|
| Polycarbonate (Z Polica, manufactured by Teijin Chemicals Ltd.) | 2.3 parts |
| Tetrahydrofuran | 200 parts |
| Cyclohexanone | 60 parts |

Evaluation 1 for Image Bearing Members (Fluorine Resin Particles)

Scanning electron microscope (SEM) photos are taken for 10 arbitrarily selected observation points on the surface of the obtained image bearing members by a field emission scanning electron microscope (FE-SEM) with a magnification power of 4,500. Using the obtained SEM photos and an image processing software (Image Pro Plus), the total of the projection area ratio (of the portion exposed to the surface of the surface layer) of the primary particles of the fluorine resin particles and the secondary particles formed of agglomeration of a plurality of the primary particles having an average diameter D of from 0.15 to 3 μm on the surface layer to the surface of the surface layer is obtained. The results are shown in Table 1.

Evaluation 2 for Image Bearing Members (Surface Friction Coefficient)

The surface friction coefficient of the obtained image bearing members is evaluated using the Oiler belt system described in JOP H09-166919.

Figure 12:
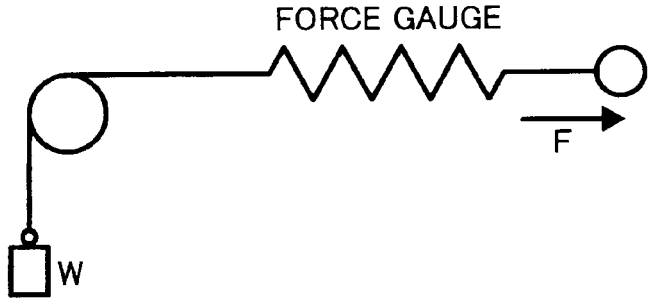
FIG. 12 is a diagram illustrating a method of measuring the surface friction coefficient of the image bearing member.

In the Oiler belt system, the friction coefficient is obtained as follows: as illustrated in FIG. 12, suspend a quality paper having a medium thickness on a quarter of the circumference of an image bearing member with the machine direction of the paper along the longitudinal direction; hook a load of 100 g on one side of a belt and a force gauge (spring balance) on the other side; gradually pull the force gauge and observe the movement of the belt; record the load when the belt starts moving; and calculate the friction coefficient of the image bearing member according to the relationship (3) represented below.

In FIG. 12, a 100 g deadman as a load, Type 6200 as a belt, longitudinal direction as machine direction, A4 size paper, 30 mm width (cut along the machine direction) and two double clips are used. The results are shown in Table 1.

$$\mu=2/\pi\times\ln(F/W) \qquad \text{Relationship (3)}$$

In the relationship (3), μ represents a friction coefficient, F represents a tension force and W represents a load (100 g).

Evaluation 3 for Image Bearing Members (Total Runout)

A flange gear is attached to each obtained image bearing member. The image bearing member is rotated relative to the center of the driving axis of the flange gear. The distance between the image bearing member and a knife edge disposed in parallel with the center of the driving axis is measured all over the imaging area of the image bearing member by a laser beam. The difference between the maximum and the minimum of the distance is obtained and determined as the total runout of the image bearing member. The result is shown in Table 1.

TABLE 1

| | | Volume ratio (vol %) of fluorine resin particles | Total area (%) of particles (0.15 ≦ D ≦ 3 μm) | Initial surface friction coefficient | Total runout (mm) |
|---|---|---|---|---|---|
| Manufacturing Example 1 | Image bearing member 1 | 0 | — | 0.55 | 0.072 |

TABLE 1-continued

| | | Volume ratio (vol %) of fluorine resin particles | Total area (%) of particles (0.15 ≦ D ≦ 3 μm) | Initial surface friction coef-ficient | Total runout (mm) |
|---|---|---|---|---|---|
| Manufacturing Example 2 | Image bearing member 2 | 12 | 7.9 | 0.32 | 0.065 |
| Manufacturing Example 3 | Image bearing member 3 | 21 | 16.5 | 0.26 | 0.051 |
| Manufacturing Example 4 | Image bearing member 4 | 36 | 25.4 | 0.22 | 0.073 |
| Manufacturing Example 5 | Image bearing member 5 | 62 | 32.8 | 0.20 | 0.064 |

Manufacturing Example 6

Manufacturing of Toner 1

The following components are placed in a reacting container equipped with a condenser, a stirrer and a nitrogen introducing tube and poly-condensed for 10 hours at 210° C. under normal pressure.

| | |
|---|---|
| Adduct of bisphenol A with 2 moles of ethylene oxide | 690 parts |
| Terephthalic acid | 230 parts |

The reaction is further performed for 5 hours under a reduced pressure of from 10 to 15 mmHg.

Subsequent to cooling down to 160°, 18 parts of phthalic anhydride are added thereto and the resulting mixture is allowed to react for 2 hours to synthesize Unmodified polyester (a) (weight average molecular weight (Mw): 85,000).

The following components are placed in a reacting container equipped with a condenser, a stirrer and a nitrogen introducing tube and reacted for 8 hours at 230° C. under normal pressure.

| | |
|---|---|
| Adduct of bisphenol A with 2 moles of ethylene oxide | 800 parts |
| Isophthalic acid | 160 parts |
| Terephthalic acid | 60 parts |
| Dibutyl tin oxide | 2 parts |

The reaction is further performed for 5 hours under a reduced pressure of from 10 to 15 mmHg while dehydrating.

Subsequent to cooling down to 160° C., 32 parts of phthalic anhydride are added thereto and the resulting mixture is allowed to react for 2 hours.

Subsequent to cooling down to 80° C., 170 parts of isophorone diisocyanate are added thereto and the mixture is reacted in ethyl acetate for 2 hours to synthesize Prepolymer (1) (weight average molecular weight (Mw): 35,000) containing isocyanate groups.

The following components are placed in a reacting container equipped with a stirrer and a temperature and reacted for 5 hours at 50° C. to synthesize Ketimine compound (2).

| | |
|---|---|
| Isophorone diamine | 30 parts |
| Methylethyl ketone | 70 parts |

Next, the following components are placed, stirred and dissolved in a beaker.

| | |
|---|---|
| Prepolymer (1) | 14.3 parts |
| Unmodified polyester (a) | 55 parts |
| Ethylacetate | 78.6 parts |

Ten parts of rice wax (melting point: 83° C.) and 4 parts of carbon black are added thereto at 40° C. and the mixture is stirred with TK type Homomixer at 12,000 rpm for 5 minutes. The resultant is subject to pulverization with a bead mill at 20° C. for 30 minutes to obtain Toner material oil liquid dispersion (3).

Subsequently, the following components are added in the beaker and Water liquid dispersion (4) is obtained.

| | |
|---|---|
| Deionized water | 306 parts |
| 10% suspension of tricalcium phosphate | 55 parts |
| Dodecylbenzene sodium sulfonate | 0.2 parts |

Toner material oil liquid dispersion (3) mentioned above and 2.7 parts of Ketimine compound (2) are added to Water liquid dispersion (4) while stirring with TK type Homomixer at 12,000 rpm to perform urea reaction. The organic solvent is removed from the liquid dispersion (viscosity: 3,500 mPas) obtained after the reaction at a temperature not higher than 50° C. with a reduced pressure within an hour. Thereafter, the resultant is filtered, washed, dried and air classified to obtain Mother toner particle (5) having a sphere form.

Next, 100 parts of Mother toner particle (5) and 0.25 parts of a charge controlling agent (BONTRON E-84, manufactured by Orient Chemical Industries, Ltd.) are placed in a Q type mixer (manufactured by Mitsui Mining Co., Ltd.) and subject to a mixing treatment with the peripheral velocity of the turbine type wing set to be 50 m/sec. This mixing treatment is performed for 5 cycles (a cycle of 2 minute operation and 1 minute downtime), that is, the mixing treatment time is 10 minutes in total.

Next, 0.5 parts of hydrophobic silica (H2000, manufactured by Clariant Japan) is added and subject to mixing treatment. This mixing treatment is performed with a peripheral velocity of 15 m/sec for 5 cycles (a cycle of 30 second mixing time and 1 minute downtime), The volume average particle diameter of the obtained toner is 6.6 μm.

The suspension containing the obtained toner is passed through an imaging detection belt having a plate form. The particle image is optically detected by a CCD camera and the average circularity thereof is measured. The average circularity is obtained by dividing the circumferential length of the circle having the area equal to a projected toner area by the circumferential length of the projected toner area and can be measured by flow type particle image analyzer (FPIA-2000, manufactured by Sysmex Corporation). A specific measuring method is as follows: Add 0.1 to 0.5 ml of a surface active agent (alkyl benzene sulfonate salt) as a dispersing agent in 100 to 150 ml of water in which impure solid is removed in a container beforehand; Further add about 0.1 to 0.5 g of a measuring sample thereto; Disperse the suspension in which the measuring sample is dispersed by a supersonic dispersing device for 1 to 3 minutes; and measure the form and the distribution of the toner by the device mentioned above with the density of the liquid dispersion being 3,000 to 10,000 particles/μl. As a result of the study so far, it is found that a toner having an average circularity of not less than 0.960 is effective to form a reproducible high definition image with a suitable density. The average circularity of toner manufactured in Manufacturing Example 6 is 0.962.

Manufacturing Example 7

Cleaning Blades 1 and 2

Cleaning blades 1 and 2, formed of polyurethane rubber having the characteristics shown in Table 2, are formed by a typical method.

When each of the obtained cleaning blades is fixed on a blade holder with a free length of 7.5 mm, the straightness of each blade edge is not greater than 0.1 mm. The straightness of a cleaning blade is measured as follows: Tilt the cleaning blade to be measured at 45 degrees; measure the distance between the edge of the cleaning blade and a knife edge disposed in parallel with both ends of the imaging area of the edge of the cleaning blade which contacts the image bearing member over the imaging area with a laser beam. The difference between the maximum and the minimum of the distance is obtained and determined as the straightness of the cleaning blade.

TABLE 2

| | Blade 1 | Blade 2 |
|---|---|---|
| Hardness | 65 degree | 74 degree |
| Impact resilience | 45% | 20% |
| 100% modulus | 2.3 MPa | 2.8 MPa |
| Thickness | 2 mm | 2 mm |

Evaluation Method

The obtained image bearing member, toner and cleaning blade are installed in an image forming apparatus (imagio Neo 270, manufactured by Ricoh, Co., Ltd., remodeled in such a manner that the irradiation light source is replaced with a semiconductor laser having a wavelength of 655 nm and a torque converter is attached to the driving axis of the image bearing member) and evaluation is performed as follows.

The cleaning angle and the blade contact angle are set based on the combination shown in Table 3.

The blade contact pressure is measured by a tactile sensor I-SCAN and the contact pressure is set by adjusting the blade pressure spring. In addition, the cleaning angle is set by changing the form of the blade holder.

Under a normal temperature (23° C.) and pressure (55% RH), five documents of varying image ratios of 0.5%, 2.5%, 5%, 10% and 25% are sequentially printed in this order as one job. 200,000 images (A4 size, landscape) are printed to observe the cleaning performance with naked eyes for evaluation.

In addition, the abrasion amount of the image bearing member and the cleaning blade and the filming state of the image bearing member are evaluated and $(T_{off}-T_0)/r$ and $(T_{on}-T_0)/(T_{off}-T_0)$ are measured. The results are shown in Tables 3 and 4.

Evaluation of Image Bearing Member.

The thickness of an image bearing member after image output is measured by an eddy current type thickness measuring device to obtain the amount of abrasion (μm). The image bearing member is detached per 50,000 image outputs and the surface thereof is observed and the filming state is evaluated according to the following criteria. The results are shown in Tables 3 and 4.

Evaluation Criteria

E: No problem

G: Filming is slightly observed not with naked eyes but by an optical microscope.

F: Filming is slightly observed with naked eyes.

P: Filming is clearly observed on several spots.

B: Filming is observed all over.

Evaluation of the Abrasion Amount of Blade

Figure 13:
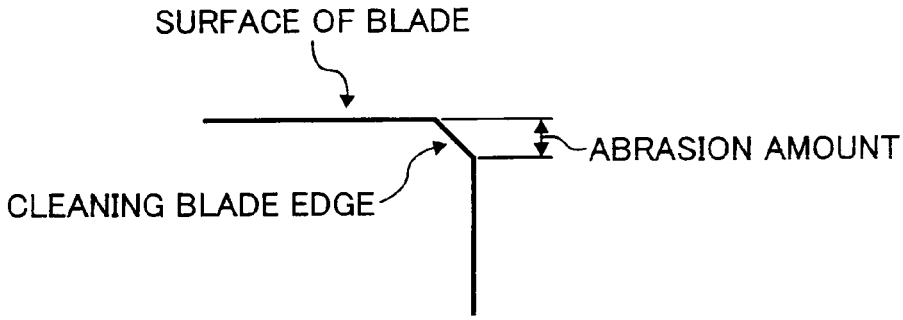
FIG. 13 is a diagram illustrating a non-limiting example of a measuring portion of the cleaning blade used to evaluate the abrasion amount thereof.

After image outputs, the cleaning blade is detached. The portion (abrasion amount of the cleaning blade, μm), which has disappeared by abrasion as illustrated in FIG. 13, is measured by a profile laser microscope (VK-8500, manufactured by Keyence Corporation).

Evaluation on Cleaning Performance for Output Images

The output images are observed with naked eyes to evaluate the cleaning performance based on the following criteria. The results are shown in Tables 3 and 4.

Evaluation Criteria

E: No problem

G: Streak is slightly observed every once in a while during sequential image outputs.

F: Streak is slightly observed in the output image with naked eyes.

P: Black Streak is clearly observed.

B: Black streaks are observed all over.

Minute Development Toner Amount

Images on the image bearing member are developed with a toner while varying the development bias. The toner used for development is transferred to a transparent tape. The amount of the toner is measured based on the reflection density. The development bias is set to have a desirable development amount of toner.

Measurement of $(T_{off}-T_0)/r$ and $(T_{off}-T_0)/(T_{off}-T_0)$

The image bearing member is attached to an image forming device without a cleaning blade. The image bearing member and other devices are rotated and driven without performing image formation for 30 seconds. A low pass filter is applied to the output of the torque converter provided to the driving axis of the image bearing member. After sampling AD conversion at a frequency of 200 Hz, the result is taken into a home computer and averaged to obtain $T_0$. Thereafter, a cleaning blade is attached and average $T_{off}$, the average of 30 seconds, is obtained in the same manner. Next, a solid image having an image density (ID) of 0.4 when tape transfer is performed is sequentially formed on the image bearing member for 30 seconds, the rotation torque thereof is measured, and $T_{on}$ is obtained in the same manner.

After outputting images at the initial stage and outputting 200,000 images, each of $(T_{off}-T_0)/r$ and $(T_{on}-T_0)/(T_{off}-T_0)$ is calculated based on the averages of $T_0$, $T_{off}$ and $T_{on}$ for 30 seconds.

TABLE 3

| | Image bearing No. | Blade No. | Cleaning angle (°) | Blade contacting pressure (g/cm) | Initial stage μ | Initial stage $(T_{off}-T_0)/r$ (kg) | Initial stage $(T_{on}-T_0)/(T_{off}-T_0)$ |
|---|---|---|---|---|---|---|---|
| Ex. 1 | Image bearing No. 3 | Blade No. 1 | 18 | 8 | 0.26 | 0.13 | 1.53 |
| Ex. 2 | Image bearing No. 3 | Blade No. 1 | 18 | 6 | 0.26 | 0.09 | 1.69 |
| Ex. 3 | Image bearing No. 3 | Blade No. 1 | 18 | 2 | 0.26 | 0.02 | 3.13 |
| Ex. 4 | Image bearing No. 3 | Blade No. 2 | 18 | 8 | 0.26 | 0.12 | 1.56 |
| Ex. 5 | Image bearing No. 3 | Blade No. 1 | 12 | 8 | 0.26 | 0.11 | 1.64 |
| Ex. 6 | Image bearing No. 3 | Blade No. 1 | 6 | 8 | 0.26 | 0.11 | 1.73 |
| Ex. 7 | Image bearing No. 4 | Blade No. 1 | 12 | 6 | 0.22 | 0.08 | 1.77 |
| Ex. 8 | Image bearing No. 5 | Blade No. 1 | 12 | 6 | 0.20 | 0.06 | 1.82 |
| Ex. 9 | Image bearing No. 4 | Blade No. 2 | 12 | 6 | 0.22 | 0.09 | 1.75 |
| Ex. 10 | Image bearing No. 5 | Blade No. 2 | 12 | 6 | 0.20 | 0.05 | 1.83 |
| Ex. 11 | Image bearing No. 4 | Blade No. 1 | 18 | 8 | 0.22 | 0.11 | 1.60 |
| Ex. 12 | Image bearing No. 4 | Blade No. 1 | 12 | 8 | 0.22 | 0.10 | 1.62 |
| Ex. 13 | Image bearing No. 4 | Blade No. 1 | 6 | 8 | 0.22 | 0.09 | 1.65 |
| Ex. 14 | Image bearing No. 4 | Blade No. 1 | 18 | 2 | 0.22 | 0.03 | 3.64 |

TABLE 3-continued

| | Image bearing No. | Blade No. | Cleaning angle (°) | Blade contacting pressure (g/cm) | Initial stage μ | Initial stage $(T_{off}-T_0)/r$ (kg) | Initial stage $(T_{on}-T_0)/(T_{off}-T_0)$ |
|---|---|---|---|---|---|---|---|
| Ex. 15 | Image bearing No. 4 | Blade No. 1 | 12 | 2 | 0.22 | 0.02 | 3.78 |
| Ex. 16 | Image bearing No. 4 | Blade No. 1 | 6 | 2 | 0.22 | 0.02 | 3.71 |
| CEx. 1 | Image bearing No. 1 | Blade No. 1 | 12 | 24 | 0.55 | 0.86 | 1.08 |
| CEx. 2 | Image bearing No. 1 | Blade No. 1 | 12 | 12 | 0.55 | 0.43 | 1.08 |
| CEx. 3 | Image bearing No. 1 | Blade No. 1 | 12 | 6 | 0.55 | 0.22 | 1.01 |
| CEx. 4 | Image bearing No. 1 | Blade No. 1 | 12 | 3 | 0.55 | 0.09 | 0.54 |
| CEx. 5 | Image bearing No. 2 | Blade No. 1 | 18 | 8 | 0.32 | 0.15 | 1.44 |
| CEx. 6 | Image bearing No. 3 | Blade No. 1 | 18 | 24 | 0.26 | 0.35 | 1.28 |
| CEx. 7 | Image bearing No. 3 | Blade No. 1 | 18 | 12 | 0.26 | 0.17 | 1.38 |
| CEx. 8 | Image bearing No. 2 | Blade No. 2 | 18 | 8 | 0.32 | 0.16 | 1.35 |
| CEx. 9 | Image bearing No. 3 | Blade No. 2 | 18 | 24 | 0.26 | 0.36 | 1.31 |
| CEx. 10 | Image bearing No. 3 | Blade No. 2 | 18 | 12 | 0.26 | 0.18 | 1.29 |
| CEx. 11 | Image bearing No. 4 | Blade No. 1 | 6 | 24 | 0.22 | 0.24 | 1.31 |
| CEx. 12 | Image bearing No. 5 | Blade No. 1 | 6 | 24 | 0.20 | 0.26 | 1.32 |

TABLE 4

| | After 20,000 image outputs μ | $(T_{off}-T_0)/r$ (kg) | $(T_{on}-T_0)/(T_{off}-T_0)$ | Abrasion amount of image bearing member (μm) | Abrasion amount of blade | Filming on image bearing member | Evaluation on cleaning performance by image | Total evaluation |
|---|---|---|---|---|---|---|---|---|
| Ex. 1 | 0.27 | 0.14 | 1.42 | 3.8 | 4.2 | G | G | G |
| Ex. 2 | 0.27 | 0.11 | 1.54 | 2.4 | 2.2 | G | G | G |
| Ex. 3 | 0.27 | 0.03 | 2.85 | 1.1 | 1.5 | G | G | G |
| Ex. 4 | 0.26 | 0.13 | 1.51 | 3.2 | 3.8 | G | G | G |
| Ex. 5 | 0.28 | 0.13 | 1.61 | 3.1 | 2.6 | G | G | G |
| Ex. 6 | 0.26 | 0.12 | 1.69 | 2.4 | 2.0 | E | E | E |
| Ex. 7 | 0.23 | 0.09 | 1.70 | 2.1 | 2.3 | E | E | E |
| Ex. 8 | 0.21 | 0.06 | 1.63 | 2.5 | 2.4 | E | E | E |
| Ex. 9 | 0.22 | 0.09 | 1.63 | 1.9 | 1.8 | E | E | E |
| Ex. 10 | 0.21 | 0.05 | 1.64 | 2.6 | 1.9 | E | E | E |
| Ex. 11 | 0.23 | 0.12 | 1.48 | 2.0 | 2.0 | E | E | E |
| Ex. 12 | 0.22 | 0.11 | 1.50 | 2.4 | 2.1 | E | E | E |
| Ex. 13 | 0.23 | 0.10 | 1.44 | 2.5 | 2.1 | E | E | E |
| Ex. 14 | 0.23 | 0.03 | 3.42 | 1.5 | 1.9 | E | E | E |
| Ex. 15 | 0.22 | 0.02 | 3.49 | 1.9 | 1.6 | E | E | E |
| Ex. 16 | 0.23 | 0.02 | 3.43 | 1.8 | 1.6 | E | E | E |

TABLE 4-continued

| | After 20,000 image outputs | | | | | | | |
|---|---|---|---|---|---|---|---|---|
| | μ | $(T_{off}-T_0)/r$ (kg) | $(T_{on}-T_0)/(T_{off}-T_0)$ | Abrasion amount of image bearing member (μm) | Abrasion amount of blade | Filming on image bearing member | Evaluation on cleaning performance by image | Total evaluation |
| CEx. 1 | Bad cleaning performance occurs at the magnitude of 100 image outputs and consequently impossible to evaluate | | | | | | | P |
| CEx. 2 | Bad cleaning performance occurs at the magnitude of 100 image outputs and consequently impossible to evaluate | | | | | | | P |
| CEx. 3 | Bad cleaning performance occurs at the magnitude of 100 image outputs and consequently impossible to evaluate | | | | | | | P |
| CEx. 4 | Bad cleaning performance occurs at the magnitude of 100 image outputs and consequently impossible to evaluate | | | | | | | P |
| CEx. 5 | 0.44 | 0.22 | 1.11 | 4.8 | 8.3 | P (After 150,000) | P (After 180,000) | P |
| CEx. 6 | 0.58 | 0.85 | 1.02 | 6.9 | 11.9 | B (After 150,000) | B (After 160,000) | P |
| CEx. 7 | 0.45 | 0.22 | 1.15 | 5.1 | 6.5 | P (After 150,000) | P (After 190,000) | P |
| CEx. 8 | 0.59 | 0.24 | 1.02 | 5.4 | 9.7 | P (After 150,000) | P (After 180,000) | P |
| CEx. 9 | 0.62 | 0.82 | 1.01 | 6.5 | 10.5 | B (After 150,000) | B (After 160,000) | P |
| CEx. 10 | 0.46 | 0.26 | 1.08 | 4.8 | 7.3 | P (After 150,000) | P (After 190,000) | P |
| CEx. 11 | 0.59 | 0.79 | 1.05 | 5.2 | 12.2 | B (After 150,000) | B (After 160,000) | P |
| CEx. 12 | 0.60 | 0.81 | 1.04 | 5.7 | 11.4 | B (After 150,000) | B (After 160,000) | P |

As seen in the results shown in Tables 3 and 4, it is found that the image forming apparatuses of Examples 1 to 16 maintain relatively good cleaning performance for a repetitive image formation over an extended period of time in comparison with those of Comparative Examples 1 to 12. Therefore, it is found that the abrasion of the image bearing member and the blade of Examples 1 to 16 is reduced, resulting in elongation of life of the image forming apparatuses.

Having now fully described embodiments of the present invention, it will be apparent to one of ordinary skill in the art that many changes and modifications can be made thereto without departing from the spirit and scope of embodiments of the invention as set forth herein.

What is claimed:

1. An image forming apparatus comprising:

an image bearing member configured to bear a latent electrostatic image, the image bearing member having a drum form and a total runout of a surface of the image bearing member relative to a driving axis thereof is not greater than 0.080 mm;

a latent electrostatic image forming device configured to form the latent electrostatic image on the image bearing member;

a developing device configured to develop and visualize the latent electrostatic image on the image bearing member with a polymerized toner including a polyester, the polymerized toner having a volume average particle diameter that ranges from 3 to 8 μm, an average circularity not less than 0.95;

a transfer device configured to transfer the visualized toner image to a recording medium; and a cleaning device comprising:

a cleaning blade configured to contact a surface of the image bearing member to remove the polymerized toner remaining thereon, a blade edge of the cleaning blade which contacts the image bearing member has a straightness of not greater than 0.1 mm, wherein a static friction coefficient μ of the image bearing member ranges from 0.1 to 0.3, a contact pressure of the cleaning blade to the image bearing member ranges from 1.5 to 10 g/cm, and the image bearing member and the cleaning blade satisfy the following relationships (1) and (2):

$$0.01\ (\text{kg}) \leqq (T_{off}-T_0)/r \leqq 0.15\ (\text{kg}) \qquad \text{Relationship (1)}$$

$$1.2 \leqq (T_{on}-T_0)/(T_{off}-T_0) \leqq 3.8, \qquad \text{Relationship (2)}$$

wherein $T_0$ represents a rotation torque (kgcm) of the image bearing member when the cleaning blade is not in contact with the surface of the image bearing member, $T_{off}$ represents a rotation torque (kgcm) of the image bearing member when the cleaning blade is brought into contact with the surface of the image bearing member and the polymerized toner is not used for development on the surface of the image bearing member, $T_{on}$ represents a rotation torque (kgcm) of the image bearing member when the cleaning blade is brought into contact with the surface of the image bearing member and the polymerized toner is used for development on the surface of the image bearing member, and r represents a radius of the image bearing member, and an uppermost layer of the image bearing member comprises fluorine resin particulates and the following relationship is satisfied:

$$0.15\ (\mu\text{m}) \leqq D \leqq 3\ (\mu\text{m}),$$

wherein D represents an average diameter of projection images of the fluorine resin particulates surfacing on the uppermost layer, and a total area of the projection images of the fluorine resin particulates is not less than 10% based on a total surface area of the uppermost layer.

2. The image forming apparatus according to claim 1, wherein a content of the fluorine resin particulates based on the uppermost layer ranges from 20 to 60 percent by volume.

3. The image forming apparatus according to claim 1, wherein the image bearing member comprises a substrate and a photosensitive layer on the substrate.

4. The image forming apparatus according to claim 3, wherein the photosensitive layer is single-layered and forms the uppermost layer.

5. The image forming apparatus according to claim 3, wherein the photosensitive layer forms the uppermost layer and comprises a charge generating layer and a charge transport layer disposed on the charge generating layer.

6. The image forming apparatus according to claim 3, wherein the image bearing member further comprises a protective layer, which is disposed on the photosensitive layer and forms the uppermost layer.

7. The image forming apparatus according to claim 1, comprising a plurality of the image bearing members, the latent electrostatic image forming devices, the developing devices, and the transfer devices.

8. The image forming apparatus according to claim 1, wherein the transfer device comprises an intermediate transfer body to which the visualized toner image formed on the image bearing member is primarily transferred and a secondary transfer device configured to secondarily transfer the visualized image borne on the intermediate transfer body to the recording medium.

9. The image forming apparatus of claim 1, wherein the following relationship is satisfied:

$$0.3\ (\mu m) \leqq D \leqq 1.5\ (\mu m).$$

10. The image forming apparatus of claim 1, wherein the following relationship is satisfied:

$$0.3\ (\mu m) \leqq D \leqq 3\ (\mu m).$$

11. The image forming apparatus of claim 1, wherein the fluorine resin particulates include at least one tetrafluoethylene resin particulates, perfluoroalkoxy resin particulates, trifluorochloroethylene resin particulates, hexafluoro ethylene propylene resin particulates, vinyl fluoride resin particulates, vinylidene fluoride resin particulates, fluorodichloro ethylene resin particulates, and copolymers thereof.

12. An image forming method comprising:

forming a latent electrostatic image on an image bearing member, the image bearing member having a drum form and a total runout of a surface of the image bearing member relative to a driving axis thereof is not greater than 0.080 mm;

developing the latent electrostatic image with a polymerized toner including a polyester to form a visualized image, the polymerized toner having a volume average particle diameter that ranges from 3 to 8 μm, an average circularity not less than 0.95;

transferring the visualized image to a recording medium; and removing the polymerized toner remaining on a surface of the image bearing member by contacting a cleaning blade therewith, a blade edge of the cleaning blade which contacts the image bearing member has a straightness of not greater than 0.1 mm, wherein a static friction coefficient μ of the image bearing member ranges from 0.1 to 0.3, a contact pressure of the cleaning blade to the image bearing member ranges from 1.5 to 10 g/cm, and the image bearing member and the cleaning blade satisfy the following relationships (1) and (2):

$$0.01\ (kg) \leqq (T_{off}-T_0)/r \leqq 0.15\ (kg) \qquad \text{Relationship (1)}$$

$$1.2 \leqq (T_{on}-T_0)/(T_{off}-T_0) \leqq 3.8, \qquad \text{Relationship (2)}$$

wherein $T_0$ represents a rotation torque (kgcm) of the image bearing member when the cleaning blade is not in contact with the surface of the image bearing member, $T_{off}$ represents a rotation torque (kgcm) of the image bearing member when the cleaning blade is brought into contact with the surface of the image bearing member and the polymerized toner is not used for development on the surface of the image bearing member, $T_{on}$ represents a rotation torque (kgcm) of the image bearing member when the cleaning blade is brought into contact with the surface of the image bearing member and the polymerized toner is used for development on the surface of the image bearing member, and r represents a radius of the image bearing member, and an uppermost layer of the image bearing member comprises fluorine resin particulates and the following relationship is satisfied:

$$0.15\ (\mu m) \leqq D \leqq 3\ (\mu m),$$

wherein D represents an average diameter of projection images of the fluorine resin particulates surfacing on the uppermost layer, and a total area of the projection images of the fluorine resin particulates is not less than 10% based on a total surface area of the uppermost layer.

13. The image forming method according to claim 12, wherein a content of the fluorine resin particulates based on the uppermost layer ranges from 20 to 60 percent by volume.

14. A process cartridge comprising:

an image bearing member configured to bear a latent electrostatic image, the image bearing member having a drum form and a total runout of a surface of the image bearing member relative to a driving axis thereof is not greater than 0.080 mm;

at least one device selected from a group including a charging device configured to charge the image bearing member, a developing device configured to develop the latent electrostatic image with a polymerized toner including a polyester, the polymerized toner having a volume average particle diameter that ranges from 3 to 8 μm, an average circularity not less than 0.95, a transfer device configured to transfer the developed image to a recording medium and a discharging device; and a cleaning device comprising a cleaning blade, configured to remove the polymerized toner remaining on a surface of the image bearing member by contacting the cleaning blade therewith, a blade edge of the cleaning blade which contacts the image bearing member has a straightness of not greater than 0.1 mm, wherein the process cartridge is configured to be detachably attached to an image forming apparatus and a static friction coefficient μ of the image bearing member ranges from 0.1 to 0.3, a contact pressure of the cleaning blade to the image bearing member ranges from 1.5 to 10 g/cm, and the image bearing member and the cleaning blade satisfy the following relationships (1) and (2):

$$0.01\ (kg) \leqq (T_{off}-T_0)/r \leqq 0.15\ (kg) \qquad \text{Relationship (1)}$$

$$1.2 \leqq (T_{on}-T_0)/(T_{off}-T_0) \leqq 3.8, \qquad \text{Relationship (2)}$$

wherein $T_0$ represents a rotation torque (kgcm) of the image bearing member when the cleaning blade is not in contact with the surface of the image bearing member, $T_{off}$ represents a rotation torque (kgcm) of the image bearing member when the cleaning blade is brought into contact with the surface of the image bearing member and the polymerized toner is not used for development on the surface of the image bearing member, $T_{on}$ represents a rotation torque (kgcm) of the image bearing member when the cleaning blade is brought into contact with the surface of the image bearing member and the polymerized toner is used for development on the surface of the image bearing member, and r represents a radius of the image bearing member, and an uppermost layer of the image bearing member comprises fluorine resin particulates and the following relationship is satisfied:

$$0.15\ (\mu m) \leqq D \leqq 3\ (\mu m),$$

wherein D represents an average diameter of projection images of the fluorine resin particulates surfacing on the uppermost layer, and a total area of the projection images of the fluorine resin particulates is not less than 10% based on a total surface area of the uppermost layer.

15. The image forming apparatus according to claim 14, wherein a content of the fluorine resin particulates based on the uppermost layer ranges from 20 to 60 percent by volume.

* * * * *